US010514623B2

(12) United States Patent
Kakehi et al.

(10) Patent No.: US 10,514,623 B2
(45) Date of Patent: Dec. 24, 2019

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Soutaro Kakehi, Kanagawa (JP); Sakon Takahashi, Kanagawa (JP); Moegi Iguchi, Kanagawa (JP); Yutaka Saito, Kanagawa (JP); Mona Tasaki, Kanagawa (JP); Yuka Yamagishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/975,779

(22) Filed: May 10, 2018

(65) Prior Publication Data

US 2019/0033738 A1 Jan. 31, 2019

(30) Foreign Application Priority Data

Jul. 28, 2017 (JP) ..... 2017-147245

(51) Int. Cl.

| | |
|---|---|
| ***G03G 9/097*** | (2006.01) |
| ***G03G 9/08*** | (2006.01) |
| *G03G 9/087* | (2006.01) |

(52) U.S. Cl.

CPC ..... *G03G 9/09708* (2013.01); *G03G 9/0819* (2013.01); *G03G 9/0825* (2013.01); *G03G 9/0827* (2013.01); *G03G 9/09716* (2013.01); *G03G 9/08755* (2013.01)

(58) Field of Classification Search

None

See application file for complete search history.

(56) References Cited

U.S. PATENT DOCUMENTS

| | | | | |
|---|---|---|---|---|
| 7,572,564 | B2 * | 8/2009 | Sato | G03G 9/0806 430/108.4 |
| 8,455,164 | B2 * | 6/2013 | Anno | G03G 9/09708 423/598 |
| 2006/0045571 | A1 * | 3/2006 | Matsuura | G03G 21/0064 399/149 |
| 2018/0088479 | A1 * | 3/2018 | Ohmori | G03G 9/0804 |
| 2018/0267416 | A1 * | 9/2018 | Uchino | G03G 9/0825 |

FOREIGN PATENT DOCUMENTS

| | | |
|---|---|---|
| JP | 2005024993 | 1/2005 |
| JP | 2016070987 | 5/2016 |
| JP | 2018155912 | * 10/2018 |

OTHER PUBLICATIONS

Espacenet machine-assisted English-language translation of JP 2018-155912 (pub. Oct. 2018) (Year: 2018).*

* cited by examiner

*Primary Examiner* — Janis L Dote

(74) *Attorney, Agent, or Firm* — JCIPRNET

(57) ABSTRACT

An electrostatic charge image developing toner includes: a toner particle that contains a releasing agent, that has an exposed portion in which the releasing agent is exposed on a surface, and in which a proportion of the exposed portion occupying a surface, which is obtained by X-ray photoelectron spectroscopic analysis is 1 atom % or more and 20 atom % or less; and a strontium titanate particle that is externally added to the toner particle, that is doped with a metal element other than titanium and strontium, and in which an average primary particle diameter is 10 nm or more and 100 nm or less.

15 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2017-147245 filed Jul. 28, 2017.

BACKGROUND

Technical Field

The present invention relates to an electrostatic charge image developing toner, an electrostatic charge image developer, and a toner cartridge.

SUMMARY

According to an aspect of the invention, there is provided an electrostatic charge image developing toner including: a toner particle that contains a releasing agent, that has an exposed portion in which the releasing agent is exposed on a surface, and in which a proportion of the exposed portion occupying a surface, which is obtained by X-ray photoelectron spectroscopic analysis is 1 atom % or more and 20 atom % or less; and a strontium titanate particle that is externally added to the toner particle, that is doped with a metal element other than titanium and strontium, and in which an average primary particle diameter is 10 nm or more and 100 nm or less.

BRIEF DESCRIPTION OF THE DRAWINGS

Exemplary embodiment(s) of the present invention will be described in detail based on the following figures, wherein.

DETAILED DESCRIPTION

Figure 1A:
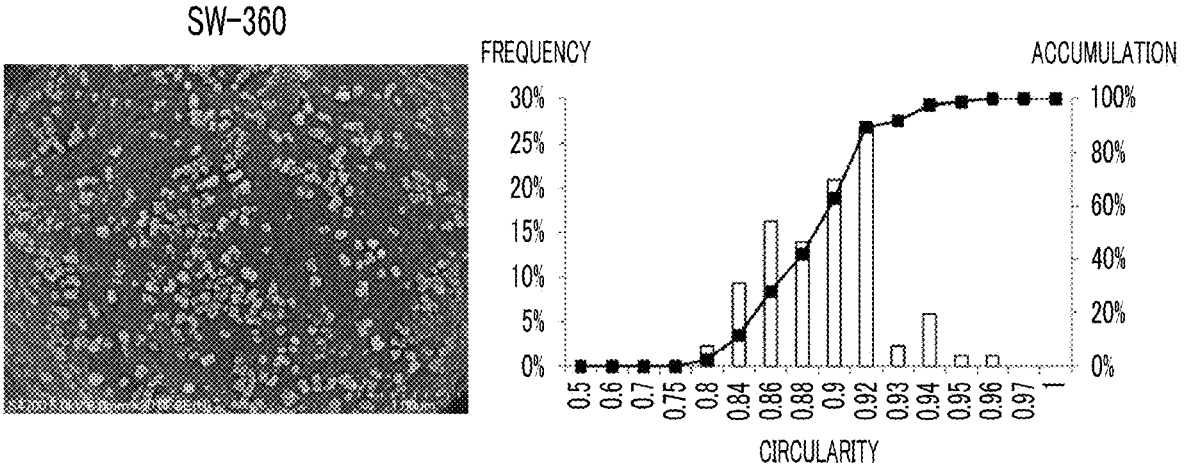
FIG. 1A is an SEM image of a toner obtained by externally adding SW-360 manufactured by Titan Kogyo, Ltd. which is an example of a strontium titanate particle and a graph of circularity distribution of strontium titanate particle obtained by analyzing the SEM image.

Hereinafter, exemplary embodiments of the present invention are described. These descriptions and examples exemplify the exemplary embodiments and do not limit the scope of the invention.

In the present disclosure, in a case of referring to the amount of each component in the composition, in a case where there are plural kinds of substances corresponding to each component in the composition, unless described otherwise, the amount means a total amount of plural substances.

In the present specification, the numerical range expressed by using "to" means a range including numerical values described before and after "to" as a lower limit value and an upper limit value.

In this disclosure, an "electrostatic charge image developing toner" is simply referred to a toner, and an "electrostatic charge image developer" is simply referred to as a "developing agent".

Electrostatic Charge Image Developing Toner

The toner according to this exemplary embodiment contains a releasing agent, a toner particle that has an exposed portion that is exposed to a releasing agent on a surface and in which a proportion of a releasing agent exposed portion occupying the surface, which is obtained by X-ray photoelectron spectroscopic analysis is 1 atom % or more and 20 atom % or less, and a strontium titanate particle that is externally added to the toner particle, that is doped with a metal element other than titanium and strontium, and that has an average primary particle diameter of 10 nm or more and 100 nm or less.

Hereinafter, a strontium titanate particle that is doped with a metal element other than titanium and strontium and that has an average primary particle diameter of 10 nm or more and 100 nm or less is referred to as a specific strontium titanate particle.

The toner according to this exemplary embodiment suppresses the occurrence of the fixing offset compared with a toner does not include the specific strontium titanate particle and including a titania particle. The fixing offset refers to a phenomenon in which a toner moves to a member such as a fixing roller and a paper feed roller from an image and a phenomenon in which an image defects causes thereby. As the mechanism, the following is assumed.

The releasing agent included in the toner particle seeps from an image surface in a case where an image is fixed and suppresses the fixing offset. In a case where an exposed portion of the releasing agent is present on the toner particle surface, a releasing agent in a case where the image is fixed effectively seeps from the image surface, and the fixing offset is more suppressed. However, in a case where a titania particle is externally added to a negatively chargeable toner that contains a negatively chargeable binder resin and in which a releasing agent exposed portion is properly present, the fixing offset occurs in some cases. As the mechanism, the following is assumed.

Both of the binder resin and the titania particle are negatively chargeable, and thus are electrostatically repulsive, such that the titania particle tends to migrate to the releasing agent exposed portion that has weaker negative chargeability than the binder resin or that is not charged. As a result, it is assumed that the titania particles cover the releasing agent exposed portion such that the seeping of the releasing agent is suppressed and the expected releasability may not be obtained. Particularly, in an environment of low temperature and low humidity (in an environment in which the external additive easily moves on the toner particles) or after an image with a low image area proportion is continuously formed (after a mechanical load is repeatedly applied to the toner in the developing device), covering of the releasing agent exposed portion by the titania particle becomes prominent, and thus the fixing offset easily occurs.

With respect to the above phenomenon, the toner according to this exemplary embodiment suppresses occurrence of fixing offset by using the specific strontium titanate particle instead of the titania particle. As the mechanism, (a), (b), and (c) are assumed.

(a) It is assumed that the specific strontium titanate particle has weaker negatively chargeability than the titania particle and thus has low electrostatic repulsive force generated between the specific strontium titanate particle and the negatively chargeable binder resin, such that the specific strontium titanate particle hardly migrates to the releasing agent exposed portion and hardly covers the releasing agent exposed portion. (b) It is assumed that, the specific strontium titanate particle is doped with a metal element and thus have a rounded shape, such that the specific strontium titanate particle hardly stays in the releasing agent exposed portion and hardly locally exists in the releasing agent exposed portion, compared with a strontium titanate particle (that is, a strontium titanate particle having angles) that is not doped with a metal element and has a shape of a cube or a rectangle. (c) The strontium titanate particle having an average primary particle diameter of less than 10 nm is easily electrostatically attracted to the releasing agent exposed portion that has weaker negatively chargeability than the negatively chargeable binder resin or that is not charged, in a case of being externally added, and the strontium titanate particle having an average primary particle diameter of more than 100 nm easily migrates to the releasing agent exposed portion by performing stirring in the developing device and easily locally exists in the releasing agent exposed portion in any cases. The specific strontium titanate particle has an average primary particle diameter of 10 nm or more and 100 nm or less, and thus hardly locally exists in the releasing agent exposed portion.

In view of (a), (b), and (c), it is assumed that the toner according to this exemplary embodiment suppresses the occurrence of the fixing offset.

Hereinafter, the configuration of manufacturing the toner according to this exemplary embodiment is specifically described.

Toner Particle

Examples of the toner particle include a binder resin and, if necessary, a colorant, a releasing agent, and other additives.

Binder Resin

Examples of the binder resin include a homopolymer of a monomer such as styrenes (for example, styrene, parachlorostyrene, and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or a vinyl-based resin including a copolymer obtained by combining two or more of these monomers.

Examples of the binder resin include a non-vinyl based resin such as an epoxy resin, a polyester resin, a polyurethane resin, a polyamide resin, a cellulose resin, a polyether resin, and a modified rosin, a mixture of these and the vinyl-based resin, or a graft polymer obtained by polymerizing a vinyl-based monomer in the coexistence thereof.

These binder resins may be used singly or two or more kinds thereof may be used in combination.

In view of negatively charging the toner particle, although not particularly limited, the binder resin is preferably negatively chargeable. In this point of view, as the binder resin, although not particularly limited, a polyester resin is preferable. Examples of the polyester resin include a condensation polymer of polyvalent carboxylic acid and polyhydric alcohol.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acid (such as cyclohexanedicarboxylic acid), aromatic dicarboxylic acid (for example, terephthalic acid, isophthalic acid, phthalic acid, and naphthalene dicarboxylic acid), anhydrides thereof, or lower alkyl ester (for example, having 1 to 5 carbon atoms) thereof. Among these, as the polyvalent carboxylic acid, for example, aromatic dicarboxylic acid is appropriate.

As the polyvalent carboxylic acid, trivalent or higher valent carboxylic acid having a crosslinked structure or a branched structure may be used together with the dicarboxylic acid. Examples of the trivalent or higher valent carboxylic acid include trimellitic acid, pyromellitic acid, anhydrides thereof, or lower alkyl esters (for example, having 1 to 5 carbon atoms) thereof.

The polyvalent carboxylic acid may be used singly or two or more kinds thereof may be used in combination.

Examples of the polyhydric alcohol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A and a propylene oxide adduct of bisphenol A). Among these, as the polyhydric alcohol, for example, aromatic diol or alicyclic diol is preferable, and aromatic diol is more preferable.

As the polyhydric alcohol, trihydric or higher hydric polyhydric alcohol having a crosslinked structure or a branched structure may be used together with diol. Examples of trihydric or higher hydric polyhydric alcohol include glycerin, trimethylolpropane, and pentaerythritol.

The polyhydric alcohol may be used singly or two or more kinds thereof may be used in combination.

The glass transition temperature (Tg) of the polyester resin is preferably 50° C. or more and 80° C. or less and more preferably 50° C. or more and 65° C. or less, for example.

The glass transition temperature is calculated from the DSC curve obtained by the differential scanning calorimetry (DSC), more specifically, is obtained from "Extrapolated glass transition onset temperature" disclosed in the method of obtaining the glass of transition temperature of "Method of measuring transition temperature of plastic" of JIS K 7121-1987.

The weight-average molecular weight (Mw) of the polyester resin is preferably 5,000 or more and 1,000,000 or less and more preferably 7,000 or more and 500,000 or less, for example. The number-average molecular weight (Mn) of the polyester resin is preferably 2,000 or more and 100,000 or less, for example. The molecular weight distribution Mw/Mn of the polyester resin is preferably 1.5 or more and 100 or less and more preferably 2 or more and 60 or less, for example.

The weight-average molecular weight and the number-average molecular weight of the polyester resin are measured by gel permeation chromatography (GPC). Measuring of the molecular weight by GPC is performed in a THF solvent by using GPC•HLC-8120 GPC manufactured by Tosoh Corporation as a measuring device and using TSK gel SuperHM-M (15 cm) manufactured by Tosoh Corporation. The weight-average molecular weight and the number-average molecular weight are calculated by using a molecular weight calibration curve prepared from a monodispersed polystyrene standard sample from this measurement result.

The polyester resin may be obtained by the well-known manufacturing method. Specifically, the polyester resin may be obtained, for example, by the method of setting the polymerization temperature to be 180° C. or more and 230° C. or less, depressurizing the inside of the reaction system if necessary, and performing the reaction while removing water and alcohol generated during the condensation.

In a case where the monomer of the raw material does not dissolve or compatibilize at the reaction temperature, a solvent having a high boiling point may be added as a dissolution aid for dissolving. In this case, the polycondensation reaction is performed while the dissolution aid is distilled off. In a case where a monomer with bad compatibility is present, the monomer having bad compatibility and the acid or alcohol to be polycondensed with the monomer may be condensed with each other in advance, so as to be polycondensed with the major component.

The content of the binder resin is preferably 40 mass % or more and 95 mass % or less, more preferably 50 mass % or more and 90 mass % or less, and even more preferably 60 mass % or more and 85 mass % or less with respect to the entire toner particle, for example.

Colorant

Examples of the colorant include pigments such as carbon black, chrome yellow, hansa yellow, benzidine yellow, suren yellow, quinoline yellow, pigment yellow, permanent orange GTR, pyrazolone orange, vulcan orange, watch young red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine-based, xanthene-based, azo-based, benzoquinone-based, azine-based, anthraquinone-based, thioindigo-based, dioxazine-based, thiazine-based, azomethine-based, indico-based, phthalocyanine-based, aniline black-based, polymethine-based, triphenyl methane-based, diphenylmethane-based, and thiazole-based dyes.

The colorant may be used singly or two or more kinds thereof may be used in combination.

As the colorant, if necessary, a surface-treated colorant may be used or a dispersing agent may be used in combination. Plural colorants may be used in combination.

The content of the colorant is preferably 1 mass % or more and 30 mass % or less and more preferably 3 mass % or more and 15 mass % or less with respect to the entire toner particle, for example.

Releasing Agent

Examples of the releasing agent include hydrocarbon wax; natural wax such as carnauba wax, rice wax, and candelilla wax; synthetic or mineral/petroleum wax such as montan wax; and ester type wax such as fatty acid ester and montanic acid ester. The releasing agent is not limited thereto.

The melting temperature of the releasing agent is preferably 50° C. or more and 110° C. or less and more preferably 60° C. or more and 100° C. or less, for example.

The melting temperature is calculated from the DSC curve obtained by the differential scanning calorimetry (DSC) by "Melting peak temperature" disclosed in the method of obtaining the melting temperature of "Method of measuring transition temperature of plastic" of JIS K 7121-1987.

The content of the releasing agent is preferably 1 mass % or more and 20 mass % or less and more preferably 5 mass % or more and 15 mass % or less, for example, with respect to the entire toner particle.

Other Additives

Examples of other additives include well-known additives such as a magnetic material, a charge control agent, and an inorganic powder. These additives are included in the toner particle as an internal additive.

Properties of Toner Particle

The toner particle may be a toner particle of a single layer structure or may be a toner particle of a so-called core-shell structure including a core part (core particle) and a coating layer (shell layer) coating the core part. The toner particle of a core-shell structure, for example, includes a core part including a binder resin and, if necessary, a colorant, a releasing agent, and the like, and a coating layer including a binder resin.

The volume average particle diameter (D50v) of the toner particle is preferably 2 μm or more and 10 μm or less and more preferably 4 μm or more and 8 μm or less, for example.

The volume average particle diameter of the toner particle is measured using COULTER MULTISIZER II (manufactured by Beckman Coulter, Inc.) and using ISOTON-II (manufactured by Beckman Coulter, Inc.) as an electrolytic solution. In the measurement, 0.5 mg or more and 50 mg or less of a measurement sample is added to 2 ml of a 5 mass % aqueous solution of a surfactant (although not particularly limited, preferably sodium alkylbenzenesulfonate) as a dispersing agent. This is added to 100 ml or more and 150 ml or less of the electrolytic solution. A dispersion treatment of the electrolytic solution in which the sample is suspended is performed for one minute with an ultrasonic disperser, and the particle diameter of the particle having a particle diameter in the range of 2 μm or more and 60 μm or less is measured by using an aperture having an aperture diameter of 100 μm by COULTER MULTISIZER II. The number of sampling particles is 50,000. In the volume-based particle size distribution of the measured particle diameter, the particle diameter which becomes 50% of the accumulation from the small diameter side is defined as the volume average particle diameter D50v.

In view of suppressing the fixing offset, the toner particle has an exposed portion in which the releasing agent is exposed, on the surface, and a proportion of the releasing agent exposed portion occupying the surface, which is obtained by the X-ray Photoelectron Spectroscopy (XPS) analysis is 1 atom % or more and 20 atom % or less. In a case where the proportion of the releasing agent exposed portion occupying the toner particle surface is less than 1 atom %, the efficiency at which the releasing agent seeps to the image surface in a case where an image is fixed is low, and the fixing offset easily occurs. Meanwhile, in a case where the proportion of the releasing agent exposed portion occupied by the toner particle surface is greater than 20 atom %, the proportion of the binder resin occupying the entire substance forming the image surface is relatively low, and thus the fixing offset easily occurs.

In view of the above, the proportion of the releasing agent exposed portion occupying the toner particle surface is preferably 1 atom % or more and 20 atom % or less, more preferably 1 atom % or more and 15 atom % or less, even more preferably 1 atom % or more and 10 atom % or less, and even more preferably 5 atom % or more and 10 atom % or less, for example.

The proportion of the releasing agent exposed portion occupying the toner particle surface is obtained in the following method.

The XPS spectrum of the toner particle surface is measured, and each peak of the carbon 1 s orbit is compared with a waveform of a reference spectrum so as to specify whether the peak is a peak belonging to the releasing agent or a peak belonging to the binding resin. The reference spectrum is an XPS spectrum measured in advance for each of the releasing agent and the binding resin forming the toner particles. The total atom % of the peak belonging to the releasing agent out of the peaks of the carbon 1 s orbit is set as a proportion of the releasing agent exposed portion.

An average diameter of the releasing agent exposed portion is preferably 200 nm or more and 600 nm or less, for example. In a case where the average diameter of the releasing agent exposed portion is 200 nm or more and, the efficiency at which the releasing agent seeps to the image surface in a case where the image is fixed, and the fixing offset is suppressed. In a case where the average diameter of the releasing agent exposed portion is 600 nm or less, a seeping amount is appropriate, and the fixing offset is suppressed.

In view of the above, the average diameter of the releasing agent exposed portion is preferably 200 nm or more and 600 nm or less, more preferably 200 nm or more and 400 nm or less, even more preferably 200 nm or more and 300 nm or less, and even more preferably 240 nm or more and 300 nm or less, for example.

A diameter of the releasing agent exposed portion according to this exemplary embodiment is a major axis (length in the longest direction) of each of the releasing agent exposed portions, and the average diameter of the releasing agent exposed portion is a diameter that becomes 50% of the accumulation from the small diameter side in the distribution based on the number of major axes.

The major axis of the releasing agent exposed portion is obtained by image-capturing a scanning electron microscope (SEM) image after the toner particle is dyed with ruthenium tetroxide, distinguishing the releasing agent from the binder resin by the shading caused by the degree of dyeing in the SEM image, and performing image analysis of at least 200 releasing agent exposed portions.

The proportion of the releasing agent exposed portion in the toner particle surface and the average diameter of the releasing agent exposed portion may be controlled by using the resin particle dispersion and the releasing agent particle dispersion in the shell formation in a case where the toner particles of the core-shell structure are produced by the aggregation coalescence method and the mixing ratio of the both.

Specific Strontium Titanate Particle

The specific strontium titanate particle is doped with a metal element other than titanium and strontium, and has an average primary particle diameter of 10 nm or more and 100 nm or less.

In view of suppressing the fixing offset, the specific strontium titanate particle has an average primary particle diameter of 10 nm or more and 100 nm or less. The strontium titanate particle having an average primary particle diameter of less than 10 nm is easily electrostatically attracted to the releasing agent exposed portion that has weaker negatively chargeability than the negatively chargeable binder resin or that is not charged, in a case of being externally added, and the strontium titanate particle having an average primary particle diameter of more than 100 nm easily migrates to the releasing agent exposed portion by performing stirring in the developing device and easily locally exists in the releasing agent exposed portion in any cases.

In view of the above, the average primary particle diameter of the specific strontium titanate particle is 10 nm or more and 100 nm or less, more preferably 20 nm or more and 80 nm or less, even more preferably 20 nm or more and 60 nm or less, and even more preferably 30 nm or more and 60 nm or less, for example.

The primary particle diameter of specific strontium titanate particle in this exemplary embodiment is the diameter (so-called circle equivalent diameter) of a circle having an area the same as the primary particle image, and the average primary particle diameter of specific strontium titanate particles is a particle diameter which becomes 50% of accumulation from the small diameter side in the distribution of primary particle diameters based on the number. The primary particle diameter of the specific strontium titanate particle is obtained by imaging an electron microscope image of a toner to which the strontium titanate particle is externally added and by performing image analysis on at least 300 points of the strontium titanate particle on the toner particle. Specific measuring methods are described in the [Examples] described below.

The average primary particle diameter of the specific strontium titanate particle may be controlled, for example, by various conditions in a case where the strontium titanate particle is manufactured by a wet process.

In view of suppressing the fixing offset, an average diameter A of the releasing agent exposed portion and an average primary particle diameter B of the specific strontium titanate particle preferably satisfies a relationship of $3 \leq A/B \leq 20$, for example.

In a case where A/B is 3 or more, a particle diameter of the specific strontium titanate particle is too great compared with the size of the releasing agent exposed portion, and thus the migrating of the specific strontium titanate particle to the releasing agent exposed portion by performing stirring in the developing device is suppressed.

In a case where A/B is 20 or less, a particle diameter of the specific strontium titanate particle is too small compared with the size of the releasing agent exposed portion, and thus the specific strontium titanate particle is electrostatically attracted to the releasing agent exposed portion that has weaker negatively chargeability than the negatively chargeable binder resin or that is not charged, in a case of being externally added, so as to suppress local existence.

In view of the above, A/B is preferably 3 or more and 20 or less, more preferably 3 or more and 15 or less, even more preferably 4 or more and 10 or less, and even more preferably 5 or more and 10 or less, for example.

In view of suppressing the fixing offset, although not particularly limited, it is preferable that the shape of the specific strontium titanate particle is a rounded shape rather than a cube or a rectangle.

The crystal structure of the strontium titanate particle is a perovskite structure, and generally the particle shape is a cube or a rectangle. However, it is assumed that the cubic or rectangular strontium titanate particle, that is, the strontium titanate particle having angles, stays in the releasing agent exposed portion, and easily locally exists.

In a case where the shape of the specific strontium titanate particle has a rounded shape, it is assumed that the specific strontium titanate particle hardly stays in the releasing agent exposed portion and hardly locally exists in the releasing agent exposed portion.

In the specific strontium titanate particle, the average primary particle circularity is 0.82 or more and 0.94 or less, and preferably the primary particle circularity that becomes 84% of the accumulation is more than 0.92, for example.

In this exemplary embodiment, the primary particle circularity of the strontium titanate particle is $4\pi\times$(area of primary particle image)/(circumference length of primary particle image)$^2$, the average primary particle circularity is circularity that becomes 50% of the accumulation from the smaller side in the circularity distribution, and the primary particle circularity that becomes 84% of accumulation is circularity that becomes 84% of the accumulation from the smaller side in the circularity distribution. The circularity of the specific strontium titanate particle is obtained by imaging an electron microscope image of a toner to which the strontium titanate particle is externally added and by performing image analysis on at least 300 points of the strontium titanate particle on the toner particle. Specific measuring methods are described in the [Examples] described below.

With respect to the specific strontium titanate particle, the primary particle circularity that becomes 84% of the accumulation is one of the indexes of a rounded shape. The primary particle circularity (hereinafter, also referred to as cumulative 84% circularity) which becomes 84% of the accumulation is described.

FIG. 1A is an SEM image of a toner obtained by externally adding SW-360 manufactured by Titan Kogyo, Ltd. which is an example of a strontium titanate particle and a graph of circularity distribution of strontium titanate particle obtained by analyzing the SEM image. As illustrated in the SEM image, in SW-360, a major particle shape is a cube, and rectangle particles and spherical particles having a relatively small particle diameter are mixed. The circularity distribution of SW-360 of this example is concentrated between 0.84 and 0.92, the average circularity is 0.888, and the cumulative 84% circularity is 0.916. It is considered that this is a reflection that the major particle shape of SW-360 is a cube, a projected image of the cube is a regular hexagon (circularity of about 0.907), a flat hexagon, a square (circularity of about 0.785), and a rectangle, a cubic strontium titanate particle adheres to the toner particles with a corner, and the projected image mostly becomes hexagonal.

According to the fact that the actual circularity distribution of SW-360 is as described above, from the theoretical circularity of the projected image of the solid, with respect to the cubic or rectangular strontium titanate particle, it is assumed that the cumulative 84% circularity of the primary particle is less than 0.92.

Figure 1B:
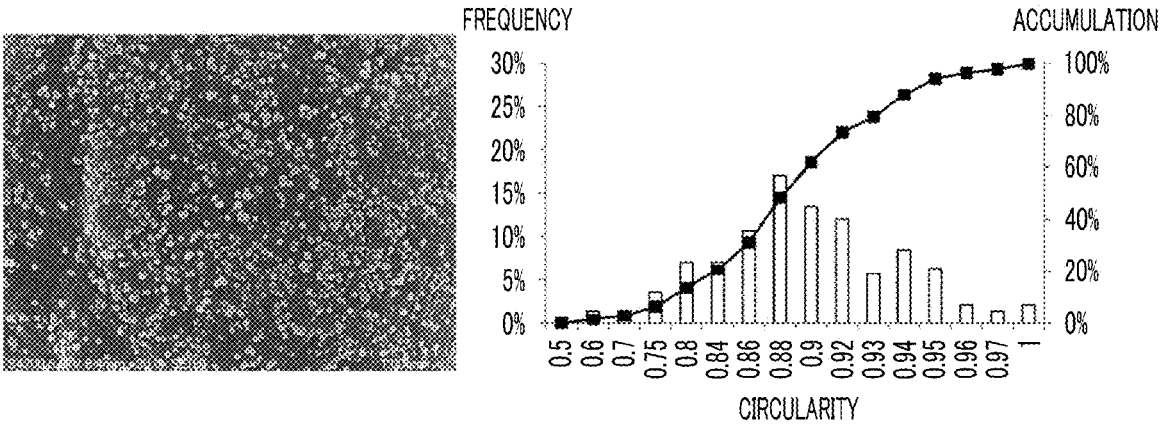
FIG. 1B is an SEM image of a toner obtained by externally adding another strontium titanate particle and a graph of circularity distribution of strontium titanate particle obtained by analyzing the SEM image.

FIG. 1B is an SEM image of a toner obtained by externally adding another strontium titanate particle and a graph of circularity distribution of strontium titanate particle obtained by analyzing the SEM image. As illustrated in the SEM image, the strontium titanate particle of this example has a rounded shape. In the strontium titanate particle of this example, the average circularity is 0.883, and the cumulative 84% circularity is 0.935.

From the above, the cumulative 84% circularity of the primary particle in the specific strontium titanate particle is one of the indexes of a rounded shape, and in a case where the cumulative 84% circularity is more than 0.92, the shape may be rounded.

In view of suppressing the fixing offset, the average primary particle circularity of the specific strontium titanate particle is preferably 0.82 or more and 0.94 or less, more preferably 0.84 or more and 0.93 or less, and even more preferably 0.86 or more and 0.92 or less, for example.

For the specific strontium titanate particles, the half-width of the peak of the (110) plane obtained by the X-ray diffraction method is preferably 0.2° or more and 2.0° or less and more preferably 0.2° or more and 1.0° or less, for example.

The peak of the (110) plane obtained by the X-ray diffraction method of the strontium titanate particle is a peak that appears near the diffraction angle 20=32°. This peak corresponds to a peak of the (110) plane of a perovskite crystal.

The strontium titanate particle having the particle shape of a cube or a rectangle has high crystallity crystallinity of the perovskite crystal, and the half-width of the peak of the (110) plane is generally less than 0.2°. For example, in a case where SW-350 manufactured by Titan Kogyo, Ltd. (strontium titanate particle of which the major particle shape is a cube) is analyzed, the half-width of the peak of the (110) plane is 0.15°.

Meanwhile, with respect to the strontium titanate particle in the rounded shape, the crystallinity of the perovskite crystal is relatively low, and the half-width of the peak of the (110) plane expands.

Although not particularly limited, it is preferable that the specific strontium titanate particle has a rounded shape. As one of the indexes of the rounded shape, the half-width of the peak of the (110) plane is preferably 0.2° or more and 2.0° or less, more preferably 0.2° or more and 1.0° or less, and even more preferably 0.2° or more and 0.5° or less, for example.

The X-ray diffraction of the strontium titanate particles is measured by using an X-ray diffractometer (for example, trade name: RINT Ultima-III, manufactured by Rigaku Corporation). The settings of the measurement are Line source CuKα, voltage 40 kV, current 40 mA, sample rotation speed: no rotation, divergence slit: 1.00 mm, divergence vertical limit slit: 10 mm, scattering slit: open, receiving slit: open, scanning mode: FT, counting time: 2.0 seconds, step width: 0.0050°, and operation axis: 10.0000° to 70.0000°. The half-width of the peak in the X-ray diffraction pattern in this disclosure is full width at half maximum.

The specific strontium titanate particle is doped with a metal element (hereinafter, also referred to as a dopant) other than titanium and strontium. In a case where the specific strontium titanate particle includes a dopant, the crystallinity of the perovskite structure is decreased, and the shape becomes rounded.

The dopant of the specific strontium titanate particle is not particularly limited, as long as the dopant is a metal element other than titanium and strontium. A metal element having an ionic radius that may enter the crystal structure forming the strontium titanate particles in a case of being ionized, for example, is preferable. In this point of view, the dopant of the specific strontium titanate particle is a metal element having an ionic radius in a case of being ionized is 40 μm or more and 200 μm or less and more preferably a metal element having an ionic radius of 60 μm or more and 150 μm or less, for example.

Examples of the dopant of the specific strontium titanate particles include lanthanoid, silica, aluminum, magnesium, calcium, barium, phosphorus, sulfur, vanadium, chromium, manganese, iron, cobalt, nickel, copper, gallium, yttrium, zinc, niobium, molybdenum, ruthenium, rhodium, palladium, silver, indium, tin, antimony, tantalum, tungsten, rhenium, osmium, iridium, platinum, and bismuth. As the lanthanoid, lanthanum and cerium are preferable, for example. Among these, from the viewpoint that the doping is easily performed, and the shape of the strontium titanate particle is easily controlled, lanthanum is preferable, for example.

As the dopant of the specific strontium titanate particles, in view of not excessively negatively charging the specific strontium titanate particle, a metal element having an electronegativity of 2.0 or less is preferable, and a metal element having an electronegativity of 1.3 or less is more preferable, for example. The electronegativity in this exemplary embodiment is Allred-Rochow electronegativity. Examples of the metal element having an electronegativity of 2.0 or less include lanthanum (electronegativity 1.08), magnesium (1.23), aluminum (1.47), silica (1.74), calcium (1.04), vanadium (1.45), chromium (1.56), manganese (1.60), iron (1.64), cobalt (1.70), nickel (1.75), copper (1.75), zinc (1.66), gallium (1.82), yttrium (1.11), zirconium (1.22), niobium (1.23), silver (1.42), indium (1.49), tin (1.72), barium (0.97), tantalum (1.33), rhenium (1.46), and cerium (1.06).

With respect to the amount of the dopant in the specific strontium titanate particles, in view of obtaining a rounded shape while having a perovskite type crystal structure, the dopant relative to strontium is preferably in the range of 0.1 mol % or more and 20 mol % or less, more preferably in the range of 0.1 mol % or more and 15 mol % or less, and even more preferably in the range of 0.1 mol % or more and 10 mol % or less, for example.

In view of improving the action of the specific strontium titanate particle, the specific strontium titanate particle is preferably a strontium titanate particle having a hydrophobized surface and more preferably a strontium titanate particle having a hydrophobized surface by a silicon-containing organic compound, for example.

Method of Manufacturing Specific Strontium Titanate Particle

The specific strontium titanate particle may be the strontium titanate particle itself and may be a particle obtained by hydrophobic treatment on the surface of the strontium titanate particle. The method of manufacturing the strontium titanate particle is not particularly limited, but may be a wet process in view of controlling a particle diameter and a shape.

Manufacturing Strontium Titanate Particle

The wet process of the strontium titanate particle is a manufacturing method of performing reaction while an aqueous alkaline solution is added to a mixed solution of a titanium oxide source and a strontium source and then performing an acid treatment. In this manufacturing method, the particle diameter of the strontium titanate particles is controlled by a mixing ratio of the titanium oxide source and the strontium source, a concentration of the titanium oxide source at the initial stage of the reaction, the temperature and the addition rate at the time of adding the aqueous alkaline solution, and the like.

As a titanium oxide source, although not particularly limited, a mineral acid peptized product of a hydrolyzate of a titanium compound is preferable. Examples of the strontium source include strontium nitrate and strontium chloride.

The mixing ratio of the titanium oxide source and the strontium source is preferably 0.9 or more and 1.4 or less and more preferably 1.05 or more and 1.20 or less in a molar ratio of $SrO/TiO_2$, for example. The concentration of the titanium oxide source in the initial stage of the reaction is preferably 0.05 mol/L or more and 1.3 mol/L or less and more preferably 0.5 mol/L or more and 1.0 mol/L or less as $TiO_2$, for example.

In view of causing the shape of the strontium titanate particle to be not a cube or a rectangle but a rounded shape, although not particularly limited, it is preferable to add a dopant source to a mixed solution of the titanium oxide source and the strontium source. Examples of the dopant source include an oxide of metal other than titanium and strontium. The metal oxide as the dopant source is added as a solution dissolved in, for example, nitric acid, hydrochloric acid, sulfuric acid, or the like. The addition amount of the dopant source is preferably an amount in which metal which is included in the dopant source is 0.1 moles or more and 20 moles or less and more preferably an amount in which metal is 0.5 moles or more and 10 moles or less with respect to 100 moles of strontium to be included in the strontium source, for example.

As the aqueous alkaline solution, although not particularly limited, a sodium hydroxide aqueous solution is preferable. As the temperature of the reaction solution at the time of adding the aqueous alkaline solution becomes higher, a strontium titanate particle having more satisfactory crystallinity may be obtained. The temperature of the reaction solution in a case where an aqueous alkaline solution is added is preferably in the range of 60° C. to 100° C., for example, in view of obtaining a rounded shape while having a perovskite type crystal structure. With respect to the addition rate of the aqueous alkaline solution, as the addition rate is lower, the strontium titanate particle having a larger particle diameter may be obtained, and as the addition rate is higher, the strontium titanate particle having a smaller particle diameter may be obtained. The addition rate of the aqueous alkaline solution, for example, is 0.001 equivalent/h or more and 1.2 equivalent/h or less and appropriately 0.002 equivalent/h or more and 1.1 equivalent/h or less with respect to the introduced raw material.

After the aqueous alkaline solution is added, an acid treatment is performed for the purpose of removing the unreacted strontium source. The acid treatment, for example, is performed by using hydrochloric acid, and pH of the reaction solution is adjusted from 2.5 to 7.0 and more preferably from 4.5 to 6.0, for example. After the acid treatment, the reaction solution is subjected to solid-liquid separation, and the solid content is subjected to a dry treatment, so as to obtain a strontium titanate particle.

Surface Treatment

The hydrophobic treatment on the surface of the strontium titanate particle is performed, for example, by preparing a treatment liquid obtained by mixing a solvent and a silicon-containing organic compound that is a hydrophobic treatment agent, mixing the strontium titanate particle and the treatment liquid under stirring, and further performing stirring continuously. After the surface treatment, the drying treatment is performed for the purpose of removing the solvent of the treatment liquid.

Examples of the silicon-containing organic compound used in the surface treatment of the strontium titanate particle include an alkoxysilane compound, a silazane compound, and silicone oil.

Examples of the alkoxysilane compound used in the surface treatment of the strontium titanate particle include tetramethoxysilane and tetraethoxysilane; methyltrimethoxysilane, ethyl trimethoxysilane, propyl trimethoxysilane, butyl trimethoxysilane, hexyltrimethoxysilane, n-octyltrimethoxysilane, decyltrimethoxysilane, dodecyltrimethoxysilane, vinyl triethoxysilane, methyltriethoxysilane, ethyl-triethoxysilane, butyl triethoxysilane, hexyltriethoxysilane, decyltriethoxysilane, dodecyltriethoxysilane, phenyltrimethoxysilane, o-methylphenyltrimethoxysilane, p-methylphenyltrimethoxysilane, phenyltriethoxysilane, and benzyltriethoxysilane; dimethyl dimethoxysilane, dimethyl diethoxysilane, methyl vinyl dimethoxysilane, methyl vinyl diethoxysilane, diphenyldimethoxysilane, and diphenyldiethoxysilane; trimethylmethoxysilane, and trimethylethoxysilane.

Examples of silazane compounds used for surface treatment of strontium titanate particles include dimethyldisilazane, trimethyldisilazane, tetramethyldisilazane, pentamethyldisilazane, and hexamethyldisilazane.

Examples of the silicone oil used for the surface treatment of the strontium titanate particles include silicone oil such as dimethyl polysiloxane, diphenyl polysiloxane, and phenylmethyl polysiloxane; and reactive silicone oil such as amino-modified polysiloxane, epoxy-modified polysiloxane, carboxyl-modified polysiloxane, carbinol-modified polysiloxane, fluorine-modified polysiloxane, methacryl-modified polysiloxane, mercapto-modified polysiloxane, and phenol-modified polysiloxane.

As the solvent used for preparing the treatment liquid, although not particularly limited, an alcohol (for example, methanol, ethanol, propanol, and butanol) is preferable in a case where the silicon-containing organic compound is an alkoxysilane compound or a silazane compound, and hydrocarbons (for example, benzene, toluene, normal hexane, and normal heptane) is preferable in a case where the silicon-containing organic compound is silicone oil.

In the treatment liquid, the concentration of the silicon-containing organic compound is preferably 1 mass % or more and 50 mass % or less, more preferably 5 mass % or more and 40 mass % or less, and even more preferably 10 mass % or more and 30 mass % or less, for example.

The amount of the silicon-containing organic compound used for the surface treatment is preferably 1 part by mass or more and 50 parts by mass or less, more preferably 5 parts by mass or more and 40 parts by mass or less, and even more preferably 5 parts by mass or more and 30 parts by mass or less, for example, with respect to 100 parts by mass of the strontium titanate particle.

The external addition amount of the specific strontium titanate particle is preferably 0.2 parts by mass or more and 4 parts by mass or less, more preferably 0.4 parts by mass or more and 3 parts by mass or less, and even more preferably 0.6 parts by mass or more and 2 parts by mass or less with respect to 100 parts by mass of the toner particle, for example.

Other External Additives

In the range of obtaining the effect of this exemplary embodiment, the toner according to this exemplary embodiment may include other external additives other than the silica particle and the strontium titanate particle. Examples of the other external additives include the following inorganic particle and the resin particle.

Examples of the other external additive include an inorganic particle. Examples of the other inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particle as the external additive may be subjected to the hydrophobic treatment. For example, the hydrophobic treatment is performed by immersing an inorganic particle to the hydrophobic treatment agent, or the like. The hydrophobic treatment agent is not particularly limited, but examples thereof include a silane coupling agent, a silicone oil, a titanate coupling agent, and an aluminum coupling agent. These may be used singly or two or more kinds thereof may be used in combination.

The amount of the hydrophobic treatment agent is generally 1 part by mass or more and 10 parts by mass or less with respect to 100 parts by mass of the inorganic particle.

Examples of the other external additive include a resin particle (a resin particle such as polystyrene, polymethyl methacrylate, and melamine resin) and a cleaning activator (for example, a particle of a fluorine-based high molecular weight substance).

The content of the other external additive is preferably 0.01 mass % or more and 5 mass % or less and more preferably 0.01 mass % or more and 2.0 mass % or less, for example, with respect to the toner particle.

Method of Manufacturing Toner

Subsequently, a method of manufacturing the toner according to this exemplary embodiment is described.

The toner according to this exemplary embodiment may be obtained by externally adding an external additive to the toner particle after the toner particle is manufactured.

The toner particle may be manufactured by any one of a dry process (for example, a kneading pulverization method) and a wet process (for example, an aggregation coalescence method, a suspension polymerization method, and a dissolution suspension method). These processes are not particularly limited, and well-known processes are employed. Among these, toner particles may be obtained by an aggregation coalescence method.

Specifically, for example, in a case where toner particles are manufactured by an aggregation coalescence method, the toner particles are manufactured by a step (resin particle dispersion preparing step) of preparing a resin particle dispersion in which a resin particle to be a binder resin is dispersed;

a step (releasing agent particle dispersion preparing step) of preparing a releasing agent particle dispersion in which a releasing agent particle is dispersed;

a step (first aggregated particle forming step) of coagulating a resin particle (other particles, if necessary) in the resin particle dispersion (in another dispersion after another particle dispersion is mixed, if necessary), so as to form a first aggregated particle;

a step (second aggregated particle forming step) of mixing a first aggregated particle dispersion in which the first aggregated particle is dispersed, the resin particle dispersion, and the releasing agent particle dispersion, and performing aggregation such that the resin particle and the releasing agent particle are attached to a surface of the first aggregated particle, so as to forma second aggregated particle; and a step (coagulation coalescence step) of heating the second aggregated particle dispersion in which the second aggregated particle is dispersed and coagulating and coalescing the second aggregated particle so as to form a toner particle.

Hereinafter, respective steps are described.

In the following description, a method for obtaining toner particles including a colorant is described, but a colorant is used, if necessary. It is obvious that, other additives other than the colorant may be used.

Resin Particle Dispersion Preparation Step

Together with the resin particle dispersion in which resin particles to be a binder resin are dispersed, for example, a colorant particle dispersion in which colorant particles are dispersed and a releasing agent particle dispersion in which releasing agent particles are dispersed are prepared.

The resin particle dispersion is prepared, for example, by dispersing resin particles in a dispersion medium by a surfactant.

Examples of the dispersion medium used for the resin particle dispersion include an aqueous medium.

Examples of the aqueous medium include water such as distilled water and ion exchanged water and alcohols. These may be used singly or two or more kinds thereof may be used in combination.

Examples of the surfactant include an anionic surfactant such as sulfate ester salt-based, sulfonate-based, phosphate ester-based, and soap-based surfactants; a cationic surfactant such as amine salt-based and quaternary ammonium salt-based surfactants; and a nonionic surfactant such as polyethylene glycol-based, alkylphenol ethylene oxide adduct-based, and polyhydric alcohol-based surfactants. Among these, particularly, an anionic surfactant and a cationic surfactant are exemplified. The nonionic surfactant may be used together with an anionic surfactant and a cationic surfactant.

The surfactant may be used singly or two or more kinds thereof may be used in combination.

With respect to the resin particle dispersion, examples of the method of dispersing the resin particles in a dispersion medium, for example, include a general dispersing method such as a rotary shearing type homogenizer, a ball mill, a sand mill, and a dyno mill having a medium. According to the types of the resin particle, the resin particles may be dispersed in the dispersion medium by a phase-transfer emulsification method. The phase-transfer emulsification method is a method of dissolving the resin to be dispersed in a hydrophobic organic solvent in which the resin is soluble and performing phase inversion from W/O to O/W by performing neutralization by adding a base to an organic continuous phase (O phase) and introducing the aqueous medium (W phase), so as to disperse the resin in a particle form in an aqueous medium.

The volume average particle diameter of the resin particles dispersed in the resin particle dispersion, for example, is preferably 0.01 μm or more and 1 μm or less, more preferably 0.08 μm or more and 0.8 μm or less, and even more preferably 0.1 μm or more and 0.6 μm or less, for example.

With respect to the volume average particle diameter of the resin particles, the particle diameter which becomes 50% of the accumulation with respect to all the particles is defined as the volume average particle diameter D50v is measured as the volume average particle diameter D50v, by subtracting the cumulative distribution from the small particle diameter side to the volume with respect to the particle size (channel) partitioned by using the particle size distribution obtained by measurement with a laser diffraction type particle size distribution determination device (for example, LA-700, manufactured by Horiba, Ltd.). The volume average particle diameter of the particles in other dispersions is measured in the same manner.

The content of the resin particle of the resin particle dispersion is preferably 5 mass % or more and 50 mass % or less and more preferably 10 mass % or more and 40 mass % or less, for example.

In the same manner as the resin particle dispersion, for example, a colorant particle dispersion and a releasing agent particle dispersion are also prepared. That is, with regard to the volume average particle diameter of the particles in the resin particle dispersion, the dispersion medium, the dispersion method, and the content of the particles, the same is applied to the releasing agent particles dispersed in the colorant particles dispersed in the colorant particle dispersion and the releasing agent particle dispersion.

First Aggregated Particle Forming Step

Subsequently, the resin particle dispersion and the colorant particle dispersion are mixed. In the mixed dispersion, the resin particles and the colorant particles are heteroaggregated and an aggregated particle including the resin particles and the colorant particles having a diameter close to the diameter of the toner particle is formed.

Specifically, for example, an aggregating agent is added to the mixed dispersion, pH of the mixed dispersion is adjusted to acidity (for example, pH 2 or more and 5 or less), a dispersion stabilizer is added, if necessary, heating is performed to a temperature (specifically, for example, glass transition temperature of resin particles of −30° C. or more and glass transition temperature of −10° C. or less) close to the glass transition temperature of the resin particles, and the particles dispersed in the mixed dispersion are aggregated, so as to form aggregated particles.

In the aggregated particle forming step, for example, heating may be performed after adding an aggregating agent at room temperature (for example, 25° C.) under stirring stirred with a rotary shearing type homogenizer with a rotary shearing type homogenizer, adjusting pH of the mixed dispersion to acidity (for example, pH 2 or more and 5 or less), and adding the dispersion stabilizer, if necessary.

Examples of the aggregating agent include a surfactant having a polarity opposite to that of the surfactant included in the mixed dispersion, inorganic metal salt, and a divalent or higher valent metal complex. In a case where a metal complex is used as the aggregating agent, the amount of the surfactant used is reduced and the charging properties are improved.

Together with the aggregating agent, an additive that forms a complex or a similar bond with a metal ion of the aggregating agent may be used, if necessary. As the additive, a chelating agent may be used.

Examples of the inorganic metal salt include metal salt such as calcium chloride, calcium nitrate, barium chloride, magnesium chloride, zinc chloride, aluminum chloride, and aluminum sulfate; and an inorganic metal salt polymer such as polyaluminum chloride, poly aluminum hydroxide, and calcium polysulfide polymer.

As the chelating agent, a water soluble chelating agent may be used. Examples of the chelating agent include oxycarboxylic acid such as tartaric acid, citric acid, and gluconic acid; and aminocarboxylic acid such as iminodiacetic acid (IDA), nitrilotriacetic acid (NTA), and ethylenediaminetetraacetic acid (EDTA).

The addition amount of the chelating agent is preferably 0.01 parts by mass or more and 5.0 parts by mass or less and more preferably 0.1 parts by mass or more and less than 3.0 parts by mass, for example, with respect to 100 parts by mass of the resin particle.

Second Aggregated Particle Forming Step

After the first aggregated particle dispersion in which the first aggregated particle is dispersed is obtained, the first aggregated particle dispersion, a resin particle dispersion, and a releasing agent particle dispersion are mixed. The resin particle dispersion and the releasing agent particle dispersion are mixed in advance, and this mixed liquid is mixed with the first aggregated particle dispersion.

A second aggregated particle is formed by performing aggregation such that the resin particle and the releasing agent particle are attached to the surface of the first aggregated particle, in a mixed dispersion in which the first aggregated particle, the resin particle, and the releasing agent particle are dispersed.

Specifically, for example, in the first aggregated particle forming step, in a case where the first aggregated particle reaches a target particle diameter, the dispersion including the resin particle and the releasing agent particle is mixed with the first aggregated particle dispersion. At this point, in order to promote the aggregation of the resin particle and the releasing agent particle to the surface of the first aggregated particle, the dispersion including the resin particle and the releasing agent particle may be mixed while the first aggregated particle dispersion is continuously heated. Subsequently, pH of the dispersion after mixing is adjusted, for example, in the range of 6.5 to 9.5, and the progressing of the aggregation is stopped.

The second aggregated particle in which the resin particle and the releasing agent particle are aggregated so as to be attached to the surface of the first aggregated particle may be obtained. According to the mixing ratio of the resin particle dispersion and the releasing agent particle dispersion used in the second aggregated particle forming step, the proportion of the releasing agent exposed portion in the toner particle surface and the average diameter of the releasing agent exposed portion are controlled.

In the series of operations described above, before the aggregation proceeding is stopped by pH adjustment, only the resin particle dispersion may be further added such that the resin particle is attached to the outermost surface of the aggregated particle.

Accordingly, the second aggregated particle in which the resin particle and the releasing agent particle are aggregated so as to be attached to the surface of the first aggregated particle, and in which the resin particle is further aggregated so as to be attached to the outermost surface may be obtained. In this case, a shell in a core-shell structure has an inner layer including a resin and a releasing agent, and an outer layer including a resin and hardly including a releasing agent. In a case where the resin particle dispersion used for forming the outer layer is relatively reduced, a toner particle in which the releasing agent is exposed on the surface may be manufactured.

In the above, a case where a releasing agent particle dispersion is not used in the first aggregated particle forming step is described, but the releasing agent particle dispersion may be used in the first aggregated particle forming step. According to the amount proportion of the releasing agent particle dispersion used in the first aggregated particle forming step and the second aggregated particle forming step, an amount proportion of the releasing agent included in the core and the shell of the core-shell structure may be controlled.

Coagulation Coalescence Step

Next, the second aggregated particle dispersion in which the second aggregated particles are dispersed is heated, for example, to be equal to or higher than the glass transition temperature of the resin particles (for example, higher than the temperature higher than the glass transition temperature of the resin particles by 10° C. to 30° C.), and the second aggregated particles are coagulated and coalesced, so as to form the toner particles having the core-shell structure.

The toner particles may be obtained through the above steps.

The toner particles may be manufactured through a step of obtaining an aggregated particle dispersion in which the aggregated particles are dispersed, further mixing the aggregated particle dispersion and the resin particle dispersion in which the resin particles are dispersed, and aggregating such that the resin particles are further adhered to the surface of the aggregated particles, to form the second aggregated particles and a step of heating the second aggregated particle dispersion in which the second aggregated particles are dispersed, and coagulating and coalescing of the second aggregated particles, to form toner particles having a core-shell structure.

After completion of the coagulation coalescence step, a well-known washing step, a well-known solid-liquid separation step, and a well-known drying step are performed on to the toner particles formed in the solution, so as to obtain toner particles in a dry state. With respect to the washing step, in view of charging performances, displacement washing with ion exchanged water may be sufficiently performed. With respect to the solid-liquid separation step, in view of productivity, suction filtration, pressure filtration, and the like may be performed. With respect to the drying step, in view of productivity, freeze-drying, air stream drying, viscous flow drying, vibrating viscous drying, and the like may be performed.

Then, the toner according to this exemplary embodiment is manufactured, for example, by adding an external additive to the obtained toner particles in a dry state and performing mixing. The mixing may be performed, for example, a V blender, a HENSCHEL MIXER, or a LOEDIGE MIXER. If necessary, coarse particles of the toner may be removed by using a vibration sieving machine, an air sieve separator, or the like.

Electrostatic Charge Image Developer

The electrostatic charge image developer according to this exemplary embodiment at least includes the toner according to this exemplary embodiment. The electrostatic charge image developer according to this exemplary embodiment may be a single component developer including only the toner according to this exemplary embodiment and may be a double component developer obtained by mixing the toner and a carrier.

The carrier is not particularly limited, and examples thereof include well-known carriers. Examples of the carrier include a coated carrier in which the surface of a core formed of magnetic powder is coated with a resin; a magnetic powder dispersed carrier formulated by dispersing in which magnetic powder in a matrix resin; and a resin impregnated carrier in which porous magnetic powder is impregnated with a resin. The magnetic powder dispersion type carrier and the resin impregnated carrier may be a carrier in which constituent particles of the carrier are used as a core, and the surface is coated with a resin.

Examples of the magnetic powder include magnetic metal such as iron, nickel, and cobalt; and magnetic oxides such as ferrite and magnetite.

Examples of the resin for coating and the matrix resin include polyethylene, polypropylene, polystyrene, polyvinyl acetate, polyvinyl alcohol, polyvinyl butyral, PVC, polyvinyl ether, polyvinyl ketone, a vinyl chloride-vinyl acetate copolymer, a styrene-acrylic acid ester copolymer, a straight silicone resin including an organosiloxane bond, or modified products thereof, a fluorine resin, polyester, polycarbonate, a phenol resin, and an epoxy resin. Additives such as conductive particles may be included in the coating resin and the matrix resin. Examples of the conductive particles include particles of metal such as gold, silver, and copper, carbon black, titanium oxide, zinc oxide, tin oxide, barium sulfate, aluminum borate, and potassium titanate.

In order to coat the surface of the core with the resin, a method of applying the coating resin and a coating layer forming solution obtained by dissolving various additives (used, if necessary) in an appropriate solvent, and the like may be exemplified. The solvent is not particularly limited and may be selected considering the kind of resin to be used, coating suitability, and the like. Specific examples of the resin coating method include an immersion method of immersing the core in a coating layer forming solution; a spraying method of spraying a coating layer forming solution to the surface of the core material; a viscous flow bed method of spraying the coating layer forming solution in a state in which the core is suspended by viscous flow air; and a kneader coater method of mixing a core of a carrier and a coating layer forming solution in a kneader coater and then removing the solvent.

The mixing ratio (mass ratio) of the toner and the carrier in the double-component developer is preferably from toner: carrier=1:100 to 30:100 and more preferably from 3:100 to 20:100, for example.

Image Forming Device and Image Forming Method

An image forming device and an image forming method according to this exemplary embodiment are described.

The image forming device according to this exemplary embodiment includes an image holding member, a charging unit that charges a surface of the image holding member, an electrostatic charge image forming unit that forms an electrostatic charge image on the charged surface of the image holding member, an developing unit that accommodates an electrostatic charge image developer and developing an electrostatic charge image formed on the surface of the image holding member by the electrostatic charge image developer as a toner image, a transfer unit that transfers a toner image formed on the surface of the image holding member to a surface of a recording medium, and a fixing unit that fixes the toner image transferred to the surface of the recording medium. As the electrostatic charge image developer, an electrostatic charge image developer according to this exemplary embodiment is applied.

In the image forming device according to this exemplary embodiment, an image forming method (the image forming method according to this exemplary embodiment) including a charging step of charging a surface of the image holding member, an electrostatic charge image forming step of forming an electrostatic charge image on the charged surface of the image holding member, an developing step of developing an electrostatic charge image formed on the surface of the image holding member by the electrostatic charge image developer according to this exemplary embodiment as a toner image, a transfer step of transferring a toner image formed on the surface of the image holding member to a surface of a recording medium, and a fixing step of fixing the toner image transferred to the surface of the recording medium is performed.

With respect to the image forming device according to this exemplary embodiment, well-known image forming devices such as a device in a direct transfer method of directly transferring a toner image formed on a surface of an image holding member to a recording medium; a device in an intermediate transfer method of firstly transferring a toner image formed on a surface of an image holding member to a surface of an intermediate transfer member and secondarily transferring the toner image transferred to the surface of the intermediate transfer member to the surface of the recording medium; a device of including a cleaning unit that cleans the surface of the image holding member after transferring of the toner image and before charging; and a device of including a discharging unit that performs discharging by irradiating the surface of the image holding member with discharging light after the transferring of the toner image and before charging.

In a case where the image forming device according to this exemplary embodiment is a device in the intermediate transferring method, a configuration in which the transfer unit, for example, includes an intermediate transfer member in which a toner image is transferred to a surface, a primary transfer unit that firstly transfers the toner image formed on the surface of the image holding member to a surface of the intermediate transfer member, and a secondary transfer unit that secondarily transfers the toner image transferred to the surface of the intermediate transfer member to a surface of a recording medium is applied.

In the image forming device according to this exemplary embodiment, for example, a portion including a developing unit may be a cartridge structure (process cartridge) that is detachably attached to the image forming device. As the process cartridge, for example, a process cartridge including a developing unit that accommodates an electrostatic charge image developer according to this exemplary embodiment may be used.

Hereinafter, an example of the image forming device according to this exemplary embodiment is described, but this exemplary invention is not limited thereto. In the description below, major portions illustrated in the drawings are described, and explanation of the others is omitted.

Figure 2:
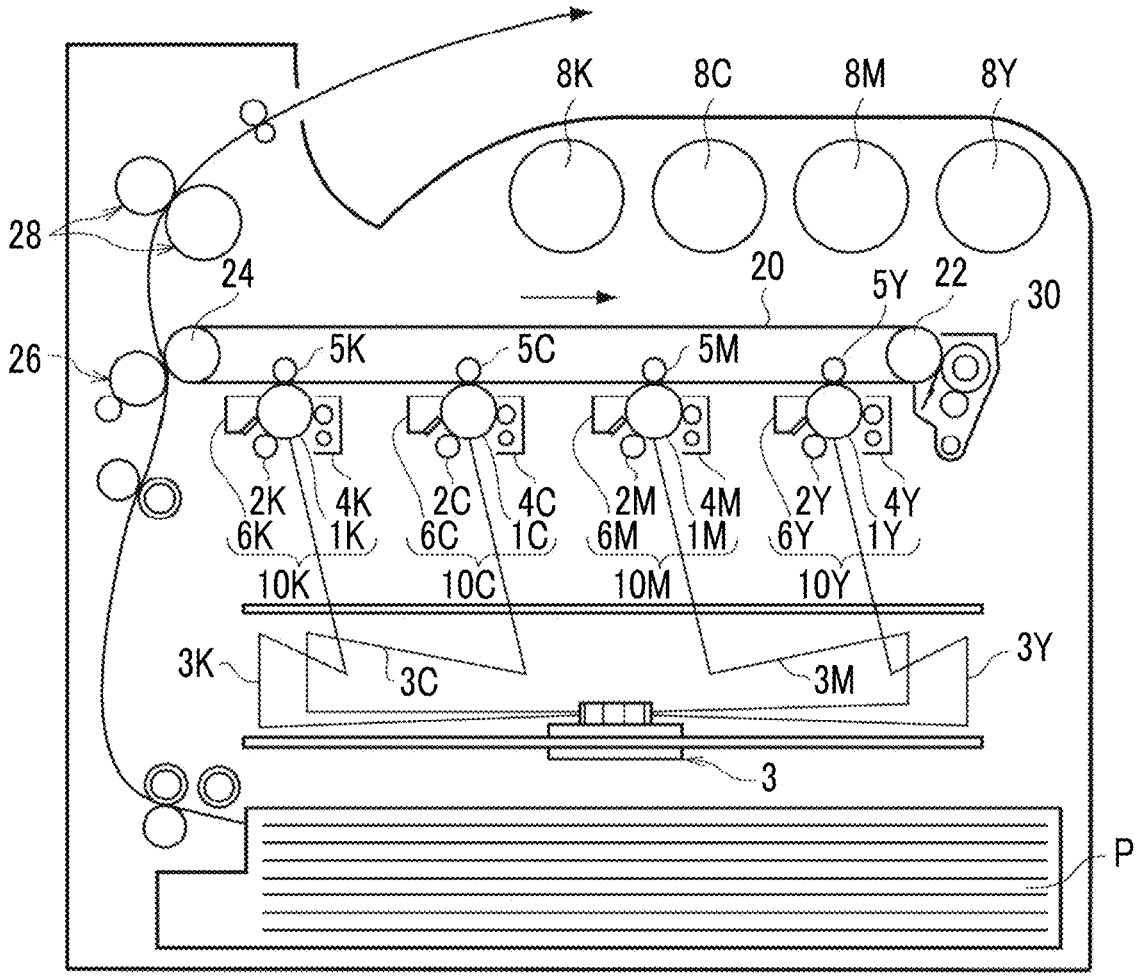
FIG. 2 is a schematic view illustrating an example of a configuration of an image forming device of this exemplary embodiment.

FIG. 2 is a schematic view illustrating the image forming device according to this exemplary embodiment.

The image forming device illustrated in FIG. 2 includes first to fourth image forming units 10Y, 10M, 10C, and 10K (image forming units) of an electrophotographic method that output images of respective colors of yellow (Y), magenta (M), cyan (C), and black (K) based on color separated image data. These image forming units (hereinafter, simply referred to as "units" in some cases) 10Y, 10M, 10C, and 10K are arranged to be parallel by being spaced in a predetermined distance from each other in a horizontal direction. These units 10Y, 10M, 10C, and 10K may be process cartridges that are detachably attached to the image forming device.

An intermediate transfer belt (an example of the intermediate transfer member) 20 is elongated on upper sides of the respective units 10Y, 10M, 10C, and 10K through the respective units. The intermediate transfer belt 20 is installed to wind a drive roller 22 and a support roller 24 that are in contact with an inner surface of the intermediate transfer belt 20 and is caused to drive in a direction from the first unit 10Y toward the fourth unit 10K. The force is applied to the support roller 24 in a direction of departing from the drive roller 22 by a spring or the like, such that tension is applied to the intermediate transfer belt 20. An intermediate transfer belt cleaning device 30 is provided on the image holding surface side of the intermediate transfer belt 20 to face the drive roller 22.

Respective toners of yellow, magenta, cyan, and black that are held in toner cartridges 8Y, 8M, 8C, and 8K are supplied to respective developing devices (an example of developing units) 4Y, 4M, 4C, and 4K of the respective units 10Y, 10M, 10C, and 10K.

The first to fourth units 10Y, 10M, 10C, and 10K have identical configuration and movements, and thus the first unit 10Y that is installed on an upper stream side in the intermediate transfer belt driving direction and forms a yellow image is representatively described.

The first unit 10Y has a photoconductor 1Y that functions as an image holding member. Around the photoconductor 1Y, a charging roller (an example of the charging unit) 2Y that charges a surface of the photoconductor 1Y in a predetermined potential, an exposing device (an example of the electrostatic charge image forming unit) 3 that exposes the charged surface with laser beams 3Y based on a color separated image signal and forms an electrostatic charge image, a developing device (an example of the developing unit) 4Y that supplies a toner charged on an electrostatic charge image and develops an electrostatic charge image, a primary transfer roller (an example of the primary transfer unit) 5Y that transfers the developed toner image on the intermediate transfer belt 20, and a photoconductor cleaning device (an example of the image holding member cleaning unit) 6Y that removes the toner remaining on the surface of the photoconductor 1Y after primary transferring.

The primary transfer roller 5Y is disposed inside the intermediate transfer belt 20 and is provided at a position facing the photoconductor 1Y. Respective bias power supplies (not illustrated) that apply primary transfer bias are connected to the primary transfer rollers 5Y, 5M, 5C, and 5K of the respective units. The respective bias power supplies change the values of the transfer bias applied to the respective primary transfer rollers according to the control of a controller (not illustrated).

Hereinafter, movements for forming a yellow image in the first unit 10Y are described.

First, prior to the movements, the surface of the photoconductor 1Y is charged by the charging roller 2Y to a potential of −600 V to −800 V.

The photoconductor 1Y is formed by laminating a photosensitive layer on a substrate having conductivity (for example, volume resistivity at 20° C. of $1\times10^{-6}$ Ωcm or less). This photosensitive layer is generally high resistance (resistance of general resin), but has properties in which the specific resistance of the portion irradiated with the laser beams changes in a case where the photosensitive layer is irradiated with laser beams. Therefore, the charged surface of the photoconductor 1Y according to image data for yellow sent from the controller (not illustrated) is irradiated with the laser beams 3Y from the exposing device 3. Accordingly, an electrostatic charge image of a yellow image pattern is formed on the surface of the photoconductor 1Y.

The electrostatic charge image is an image formed on the surface of the photoconductor 1Y by charging and is a so-called negative latent image in which the specific resistance of the irradiated portion of the photosensitive layer decreases by the laser beams 3Y such that the charged electric charged on the surface of the photoconductor 1Y flows and charges of the portion not irradiated with the laser beam 3Y are retained.

The electrostatic charge image formed on the photoconductor 1Y rotates to a predetermined developing position according to the driving of the photoconductor 1Y. In this developing position, an electrostatic charge image on the photoconductor 1Y is developed as a toner image and visualized by a developing device 4Y.

An electrostatic charge image developer including at least a yellow toner and a carrier is accommodated in the developing device 4Y. The yellow toner is frictionally electrified by being stirred inside the developing device 4Y, and has charges having the polarity the same (negative polarity) as that of the charges charged on the photoconductor 1Y and is held on a roller (an example of developer holding member). As the surface of the photoconductor 1Y passes through the developing device 4Y, the yellow toner electrostatically adheres to the latent image portion discharged on the surface of the photoconductor 1Y, and the latent image is developed with the yellow toner. The photoconductor 1Y on which the yellow toner image is formed is subsequently moved at a predetermined speed, and the toner image developed on the photoconductor 1Y is transported to a predetermined primary transfer position.

In a case where the yellow toner image on the photoconductor 1Y is transported to the primary transfer position, a primary transfer bias is applied to the primary transfer roller 5Y, the electrostatic force directed from the photoconductor 1Y toward the primary transfer roller 5Y acts on the toner image, and the toner image on the photoconductor 1Y is transferred to the intermediate transfer belt 20. The transfer bias applied at this point has a polarity (+) opposite to the polarity (−) of the toner and is controlled to +10 μA, for example, by the controller (not illustrated) in the first unit 10Y. The toner retained on the photoconductor 1Y is removed by the photoconductor cleaning device 6Y and collected.

The primary transfer bias applied to the primary transfer rollers 5M, 5C, and 5K after the second unit 10M is also controlled in accordance with the first unit.

In this manner, the intermediate transfer belt 20 to which the yellow toner image has been transferred in the first unit 10Y is transported sequentially through the second to fourth units 10M, 10C, and 10K, toner images of respective colors are superimposed and transferred in a multiplex manner.

The intermediate transfer belt 20 on which the four color toner images are transferred in a multiplex manner through the first to fourth units reaches a secondary transfer portion including an intermediate transfer belt 20, the support roller 24 in contact with the inner surface of the intermediate transfer belt, and a secondary transfer roller (an example of the secondary transfer unit) 26 disposed on the image holding surface side of the intermediate transfer belt 20. On the other hand, recording paper (an example of a recording medium) P is fed to the gap between the secondary transfer roller 26 and the intermediate transfer belt 20 via a supply mechanism at a predetermined timing, and the secondary transfer bias is applied to the support roller 24. The transfer bias applied at this point has a polarity (−) of polarity the same as the polarity (−) of the toner, and the electrostatic force directed from the intermediate transfer belt 20 toward the recording paper P acts on the toner image, and the toner image on the intermediate transfer belt 20 is transferred onto the recording paper P. The secondary transfer bias at this point is determined according to the resistance detected by a resistance detection unit (not illustrated) for detecting the resistance of the secondary transfer portion, and the voltage is controlled.

The recording paper P to which the toner image is transferred is sent to a pressure contact portion (nip portion) of a pair of fixing rollers in a fixing device (an example of the fixing unit) 28, a toner image is fixed on the recording paper P, and a fixed image is formed. The recording paper P on which fixing of the color image is completed is exported toward the discharging section, and the series of color image forming movements is ended.

Examples of the recording paper P to which the toner image is transferred include plain paper used for a copying machine or a printer in the electrophotographic method. Examples of the recording medium include an OHP sheet in addition to the recording paper P. In order to further improve the smoothness of the image surface after fixing, although not particularly limited, it is preferable that the surface of the recording paper P is also smooth. For example, coated paper obtained by coating the surface of plain paper with a resin or the like, art paper for printing, and the like may be used.

Process Cartridge and Toner Cartridge

The process cartridge according to this exemplary embodiment is a process cartridge that includes a developing unit accommodating the electrostatic charge image developer according to this exemplary embodiment and developing an electrostatic charge image formed on the surface of the image holding member by the electrostatic charge image developer as the toner image and that is detachably attached to the image forming device.

The process cartridge according to this exemplary embodiment may have a configuration of including a developing unit and, for example, at least one selected from other units such as an image holding member, a charging unit, an electrostatic charge image forming unit, and a transfer unit, if necessary.

Hereinafter, an example of the process cartridge according to this exemplary embodiment is described, but the present invention is not limited thereto. In the description below, major portions illustrated in the drawings are described, and explanation of the others is omitted.

Figure 3:
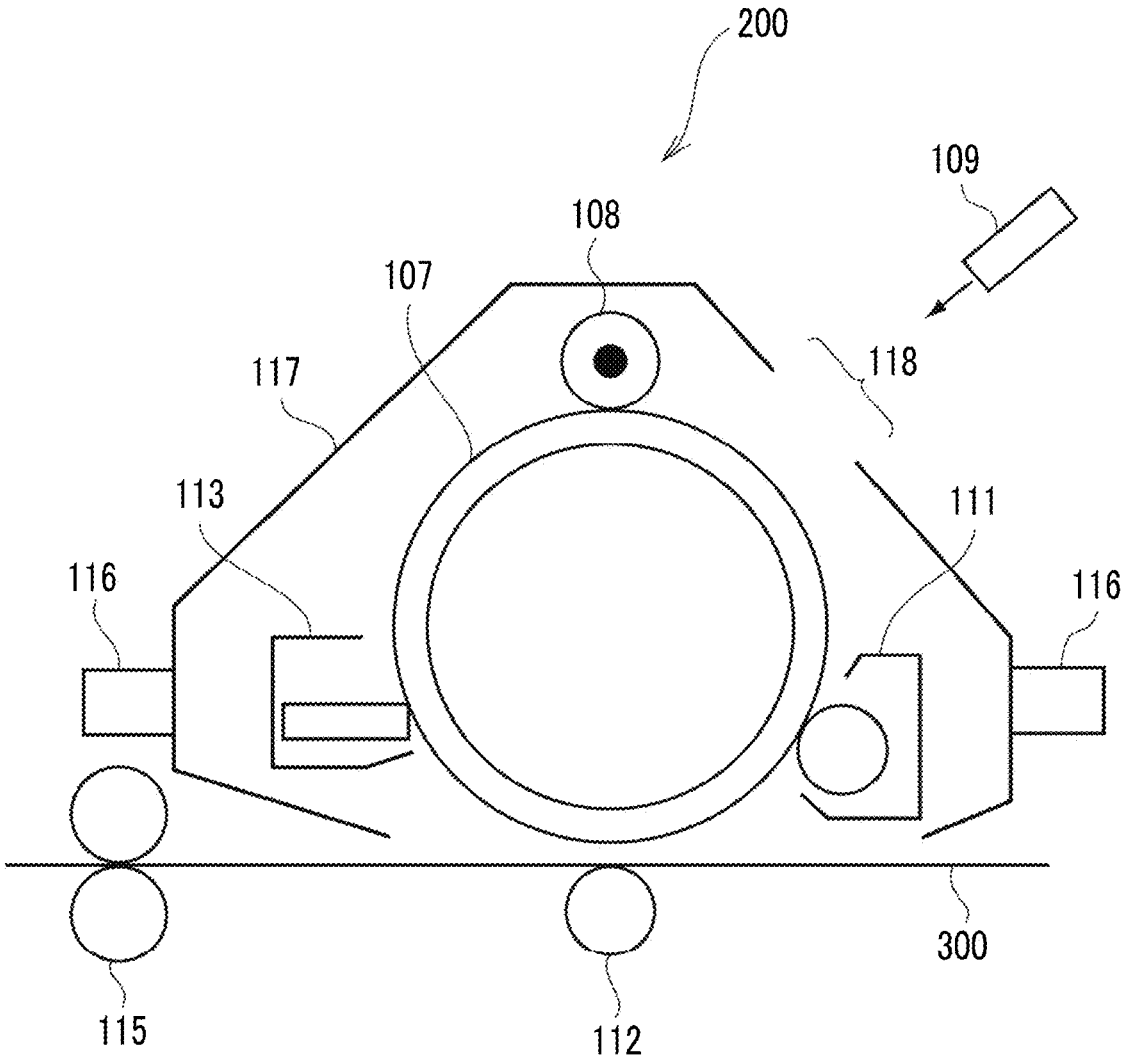
FIG. 3 is a schematic view illustrating an example of a configuration of a process cartridge of this exemplary embodiment that is detachably attached to an image forming device.

FIG. 3 is a schematic view illustrating the process cartridge according to this exemplary embodiment.

A process cartridge 200 illustrated in FIG. 3 became a cartridge combining and holding a photoconductor 107 (an example of the image holding member), a charging roller 108 (an example of the charging unit) around the photoconductor 107, a developing device 111 (an example of the developing unit), and a photoconductor cleaning device 113 (an example of the cleaning unit) in an integrated manner, for example, by a housing 117 including a mounting rail 116 and an opening 118 for exposure.

In FIG. 3, 109 indicates an exposing device (an example of the electrostatic charge image forming unit), 112 indicates a transfer device (an example of the transfer unit), 115 indicates a fixing device (an example of the fixing unit), and 300 indicates a recording paper (an example of the recording medium).

Subsequently, the toner cartridge according to this exemplary embodiment is described.

The toner cartridge according to this exemplary embodiment is a toner cartridge that includes a container that accommodates the toner according to this exemplary embodiment and is detachably attached to the image forming device. The toner cartridge includes the container that accommodates the replenishing toner for being supplied to the developing unit provided in the image forming device.

The image forming device illustrated in FIG. 2 is an image forming device having a configuration in which the toner cartridges 8Y, 8M, 8C, and 8K are detachably attached, and the developing devices 4Y, 4M, 4C, and 4K are connected to the toner cartridges corresponding to the respective colors by toner supply tubes (not illustrated). In a case where the toner that is accommodated in the container in the toner cartridge becomes less, this toner cartridge is replaced.

EXAMPLES

Hereinafter, the exemplary embodiment of the present invention is specifically described with reference to examples, but the present invention is not limited to these examples. Herein, unless otherwise specified, "part" and "%" are based on mass.

Preparation of Toner Particle

Toner Particle (1)

Preparation of Resin Particle Dispersion (1)

Ethylene glycol: 37 parts

Neopentyl glycol: 65 parts 1,9-Nonanediol: 32 parts

Terephthalic acid: 96 parts

The above materials are introduced to a flask equipped with a stirrer, a nitrogen introduction pipe, a temperature sensor, and a rectification column, the temperature is raised to 200° C. over one hour, and 1.2 parts of dibutyltin oxide are introduced. While generated water is distilled off, the temperature is raised to 240° C. over 6 hours, the dehydration condensation reaction is continued for four hours at 240° C., and the reaction product is cooled. In this manner, a polyester resin having a weight-average molecular weight of 13,000, an acid value of 9.4 mgKOH/g, and a glass transition temperature of 62° C. is obtained.

While the polyester resin is in a molten state, the polyester resin is transferred to CAVITRON CD1010 (manufactured by Eurotec Co., Ltd.) at a rate of 100 parts per minute. While separately prepared dilute ammonia water at a concentration of 0.37 mass % is heated to 120° C. with a heat exchanger, the dilute ammonia water is transferred to CAVITRON simultaneously with a polyester resin at a rate of 0.1 liters per minute. CAVITRON is driven under the condition that the rotation speed of the rotor is 60 Hz and the pressure is 5 kg/cm$^2$ so as to obtain a resin particle dispersion (1) having a solid content of 30 mass % in which a resin particle having a volume average particle size of 160 nm is dispersed.

Preparation of Colorant Particle Dispersion (1)

C. I. Pigment Blue 15:3 (Dainichiseika Color & Chemicals Mfg. Co., Ltd.): 10 parts Anionic surfactant (Dai-Ichi Kogyo Seiyaku Co., Ltd., NEOGEN SC): 2 parts Ion exchanged water: 80 parts The materials are mixed and dispersed for one hour by using a high pressure impact type dispersing machine ULTIMIZER (HJP 30006 manufactured by Sugino Machine Co., Ltd.), so as to obtain a colorant particle dispersion (1) in which a colorant particle having a volume average particle diameter of 180 nm is dispersed and a solid content is 20 mass %.

Preparation of Releasing Agent Particle Dispersion (1)

Polyethylene-based wax (POLYWAX 725 manufactured by Baker Petrolite Corporation, melting temperature 104° C.) 270 parts Anionic surfactant (NEOGEN RK, manufactured by Dai-ichi Kogyo Seiyaku Co., Ltd.): 13.5 part Ion exchanged water: 21.6 parts The materials are mixed and heated to 120° C. such that the wax is dissolved, the dispersion treatment is performed at a dispersion pressure of 5 MPa for two hours and continuously at a dispersion pressure of 40 MPa for six hours by using a pressure discharge type homogenizer (GAULIN HOMOGENIZER manufactured by Gaulin Co. Ltd.), and cooling is performed, so as to obtain a dispersion. Ion exchanged water is added such that the solid content is adjusted to 25 mass %, so as to obtain a releasing agent particle dispersion (1). The volume average particle diameter of a particle in the releasing agent particle dispersion (1) is 250 nm.

Manufacturing of Toner Particle (1)

Resin particle dispersion (1): 223 parts

Colorant particle dispersion (1): 20 parts

Ion exchanged water: 215 parts

Anionic surfactant (NEOGEN RK, manufactured by Dai-ichi Kogyo Seiyaku Co., Ltd.): 2.8 parts The materials are introduced to a reaction container equipped with a thermometer, a pH meter, and a stirrer, are heated to a temperature of 30° C. from the outside with a mantle heater, and are left for 30 minutes while stirring is performed at a stirring rotation speed of 150 rpm. Subsequently, a 0.3 N nitric acid aqueous solution is added to adjust pH to 3.0. Subsequently, while dispersing is performed with a homogenizer (ULTRA-TURRAX T50, manufactured by IKAWorks, Inc.), a solution obtained by dissolving 0.7 parts of polyaluminum chloride (30% powder manufactured by Oji Paper Co., Ltd.) in 7 parts of ion exchanged water is added. Subsequently, the temperature is raised to 50° C. under stirring, and the particle diameter of an aggregated particle (first aggregated particle) is measured with COULTER MULTISIZER II (aperture diameter 50 μm, manufactured by Beckman Coulter Inc.), so as to check that the volume average particle diameter is 5.0 μm.

Subsequently, 3 parts of the releasing agent particle dispersion (1) are added to the first aggregated particle dispersion over 10 minutes, 57 parts of the resin particle dispersion (1) and 12 parts of the releasing agent particle dispersion (1) are added over 15 minutes, 20 parts of the resin particle dispersion (1) are further added over 15 minutes after 30 minutes, and the releasing agent particle and the resin particle are attached to the surface of the first aggregated particle, so as to form a second aggregated particle. Subsequently, 20 parts of 10% NTA (nitrilotriacetic acid) metal salt aqueous solution (CHELEST 70 manufactured by Chelest Corporation) are added, and a 1 N sodium hydroxide aqueous solution is added to adjust the pH to 9.0. Subsequently, the temperature is raised to 90° C. at a temperature rise speed of 0.05° C./min, is maintained at 90° C. for three hours such that the second aggregated particle is coagulated and coalesced, and the dispersion liquid is cooled.

The solid content obtained by filtering the dispersion is repeatedly redispersed in ion exchanged water, so as to perform washing. Thereafter, vacuum drying is performed in an oven at 40° C. for five hours so as to obtain a toner particle (1) having a volume average particle diameter of 6.5 μm.

Toner Particle (2)

In the step of forming the second aggregated particle, a toner particle (2) is manufactured in the same manner as in the manufacturing of the toner particle (1), except for adding 3 parts of the releasing agent particle dispersion (1) over 10 minutes, adding a liquid obtained by mixing 57 parts of the resin particle dispersion (1) and 6 parts of the releasing agent particle dispersion (1) over 15 minutes, and further adding 20 parts of the resin particle dispersion (1) over 15 minutes after 30 minutes. The volume average particle diameter of the toner particle (2) is 6.6 μm.

Toner Particle (3)

In the step of forming the second aggregated particle, a toner particle (3) is manufactured in the same manner as in the manufacturing of the toner particle (1), except for adding 3 parts of the releasing agent particle dispersion (1) over 10 minutes, adding a liquid obtained by mixing 57 parts of the resin particle dispersion (1) and 18 parts of the releasing agent particle dispersion (1) over 15 minutes, and further adding 20 parts of the resin particle dispersion (1) over 15 minutes after 30 minutes. The volume average particle diameter of the toner particle (3) is 6.4 μm.

Toner Particle (4)

In the step of forming the second aggregated particle, a toner particle (4) is manufactured in the same manner as in the manufacturing of the toner particle (1), except for adding 3 parts of the releasing agent particle dispersion (1) over 10 minutes, adding a liquid obtained by mixing 57 parts of the resin particle dispersion (1) and 3 parts of the releasing agent particle dispersion (1) over 15 minutes, and further adding 20 parts of the resin particle dispersion (1) over 15 minutes after 30 minutes. The volume average particle diameter of the toner particle (4) is 6.7 μm.

Toner Particle (5)

In the step of forming the second aggregated particle, a toner particle (5) is manufactured in the same manner as in the manufacturing of the toner particle (1), except for adding 3 parts of the releasing agent particle dispersion (1) over 10 minutes, adding a liquid obtained by mixing 57 parts of the resin particle dispersion (1) and 24 parts of the releasing agent particle dispersion (1) over 15 minutes, and further adding 20 parts of the resin particle dispersion (1) over 15 minutes after 30 minutes. The volume average particle diameter of the toner particle (5) is 6.3 μm.

Manufacturing of Strontium Titanate Particle

Strontium Titanate Particle (1)

0.7 mol of metatitanic acid which is a desulfurized and deflocculated titanium source as $TiO_2$ is sampled and put into a reaction container. Subsequently, 0.78 mol of a strontium chloride aqueous solution is added to the reaction container such that the $SrO/TiO_2$ molar ratio becomes 1.11. Subsequently, a lanthanum nitrate hexahydrate aqueous solution is added to the reaction container in an amount in which lanthanum becomes 2.5 moles with respect to 100 moles of strontium. The initial concentration of $TiO_2$ in the mixed solution of the three materials is caused to be 0.7 mol/L. Subsequently, the mixed solution is stirred, the mixed solution is heated to 90° C., the temperature of the liquid is maintained at 90° C., 153 mL of a 10 N sodium hydroxide aqueous solution is added over 3.8 hours under stirring, and stirring is continuously performed over one hour while the temperature of the liquid is maintained at 90° C. Subsequently, the reaction solution is cooled to 40° C., hydrochloric acid is added until pH becomes 5.5, and stirring is performed over one hour. Subsequently, the precipitate is washed by repeating decantation and redispersion in water. Hydrochloric acid is added to the slurry containing the washed precipitate, pH is adjusted to 6.5, solid-liquid separation is performed by filtration, and the solid content is dried. An ethanol solution of i-butyltrimethoxysilane is added to the dried solid content in an amount that i-butyltrimethoxysilane becomes 10 parts with respect to 100 parts of the solid content, and stirring is performed for one hour. Solid-liquid separation is performed by filtration, and the solid content is dried over seven hours in the atmosphere of 130° C., so as to obtain a strontium titanate particle (1).

Strontium Titanate Particle (2)

A strontium titanate particle (2) is manufactured in the same manner as the manufacturing of the strontium titanate particles (1), except for changing the time for the dropwise addition of the 10 N sodium hydroxide aqueous solution to one hour.

Strontium Titanate Particle (3)

A strontium titanate particle (3) is manufactured in the same manner as the manufacturing of the strontium titanate particles (1), except for changing the time for the dropwise addition of the 10 N sodium hydroxide aqueous solution to three hours.

Strontium Titanate Particle (4)

A strontium titanate particle (4) is manufactured in the same manner as the manufacturing of the strontium titanate particles (1), except for changing the time for the dropwise addition of the 10 N sodium hydroxide aqueous solution to 9.5 hours.

Strontium Titanate Particle (5)

A strontium titanate particle (5) is manufactured in the same manner as the manufacturing of the strontium titanate particles (1), except for changing the time for the dropwise addition of the 10 N sodium hydroxide aqueous solution to 13.5 hours.

Strontium Titanate Particle (6)

A strontium titanate particle (6) is manufactured in the same manner as the manufacturing of the strontium titanate particles (1), except for changing the time for the dropwise addition of the 10 N sodium hydroxide aqueous solution to 18 hours.

Strontium Titanate Particle (7)

SW-360 manufactured by Titan Kogyo, Ltd. is prepared as a strontium titanate particle (7). SW-360 is a strontium titanate particle which is not doped with a metal element and of which surface is untreated.

Preparing of Titanium Oxide Particle

JMT-150IB manufactured by Tayca Corporation is prepared as the titanium oxide particle (1). JMT-150IB is a titanium oxide particle of which surface is hydrophobized with isobutylsilane.

Manufacturing of Carrier

Ferrite particle (volume average particle diameter: 50 μm): 100 parts

Toluene: 14 parts

Styrene-methyl methacrylate copolymer (copolymer proportion 90/10, Mw 80,000): 2 parts Carbon black (R330, manufactured by Cabot Corporation):

0.2 parts

The materials except the ferrite particle are dispersed with a stirrer to prepare a dispersion, the dispersion is put into a vacuum degassing type kneader together with a ferrite particle and dried under reduced pressure under stirring so as to obtain a carrier.

Manufacturing of Toner and Developer: Examples 1 to 15 and Comparative Examples 1 to 11

0.82 parts of any one of the strontium titanate particles (1) to (7) or the titanium oxide particle (1) are added to 100 parts of any one of the toner particles (1) to (5) in the combinations presented in Table 1, and mixing is performed for 15 minutes at a stirring circumferential speed of 30 m/seconds by using a HENSCHEL mixer. Subsequently, sieving is performed by using an oscillating sieve having an opening of 45 μm, so as to obtain an externally added toner.

5 parts of the externally added toner and 95 parts of the carrier are introduced to a V blender and stirred for 20 minutes. Thereafter, sieving is performed with a sieve having an opening of 212 μm so as to obtain a developer.

Analysis of Toner

Proportion of Releasing Agent Exposed Portion in Toner Particle Surface

A toner particle before an external additive is externally added is used as a sample. An XPS spectrum of the toner particle surface is measured by using JPS-9000 MX manufactured by JEOL Ltd. as an XPS device, using MgKα rays as an X-ray source, and setting an accelerating voltage of 10 kV and an emission current of 30 mA. Separately, the XPS spectrum is measured for each of the releasing agent and the polyester resin which are the material of the toner particles, and the reference spectrum of the carbon 1 s orbit is obtained.

Each peak of the carbon 1s orbit on the surface of the toner particle is compared with the reference spectrum by curve fitting according to the least squares method so as to specify a peak belonging to the releasing agent. The total atom % of the peak belonging to the releasing agent is set as a proportion of the releasing agent exposed portion.

In the case of obtaining the proportion of the releasing agent exposed portion on the toner surface from the toner to which the strontium titanate particle, the silica particle, and the like are externally added, the following treatment and measuring method may be applied.

In a 200 mL glass bottle, 40 mL of a 0.2 mass % aqueous solution of TRITON X-100 (manufactured by Acros Organics B.V.B.A.) and 2 g of a toner are introduced and stirring is performed 500 times, so as to be dispersed. Subsequently, ultrasonic waves are applied by using an ultrasonic homogenizer (US-300AT, manufactured by Nippon Seiki Co., Ltd.) while the liquid temperature of the dispersion is maintained at 20° C.±0.5° C. Ultrasonic wave application is continuously performed for application time: 30 seconds, output: 75 W, amplitude:180 μm, and a distance between the ultrasonic transducer and the bottom of the container: 10 mm. Subsequently, the dispersion is centrifuged at 3,000 rpm for 2 minutes at a cooling temperature of 0° C. by using a small high-speed cooling centrifuger (manufactured by Sakuma Seisakusho Co., Ltd, M201-IVD), and a supernatant is removed. The remaining slurry is dried to obtain toner particles to which no external additive is externally added, and an XPS spectrum of the surface of the toner particle is measured. The treatment of separating the external additive from the toner may be repeated until the external additive may be separated. The treatment of separating the external additive from the toner may be a treatment method other than the above as long as the external additive may be separated.

Average Diameter of Releasing Agent Exposed Portion on Toner Particle Surface

A toner particle before an external additive is externally added is used as a sample. The toner particle is dyed with ruthenium tetroxide in a desiccator at 30° C. for three hours. An SEM image of the dyed toner is captured by SEM (S-4800, manufactured by Hitachi High-Technologies Corporation). Since the releasing agent is more easily dyed in ruthenium tetroxide than the polyester resin, the releasing agent and the polyester resin are distinguished from each other by the shading caused by the degree of dyeing, and 200 toner particles in which the releasing agent exposed portions are positioned in the central portions are subjected to image analysis, so as to measure a major axis (the length in the longest direction) of the releasing agent exposed portion. A major axis which becomes 50% of the accumulation from the small diameter side in the distribution based on the number of 200 major axes is set as an average diameter.

In order to observe the releasing agent exposed portion of the toner to which the external additive is externally added, the releasing agent exposed portion may be observed after a toner particle to which no external additive is externally added is obtained by performing an external additive separation treatment.

Shape Properties of Strontium Titanate Particle

Separately prepared toner particles and strontium titanate particles are mixed for 15 minutes at a stirring circumferential speed of 30 m/sec using a HENSCHEL MIXER. Subsequently, sieving is performed by using an oscillating sieve having an opening of 45 μm, so as to obtain an externally added toner to which strontium titanate particles are attached.

An image of the externally added toner is taken at a magnification of 40,000 times by using a scanning electron microscope (SEM) (S-4700 manufactured by Hitachi High-Technologies Corporation). Image information of 300 randomly selected strontium titanate particles is analyzed with an image processing analysis software WinRoof (Mitani Corporation) via an interface, and the circle equivalent diameter, the area, and the perimeter of each primary particle image are calculated, so as to obtain circularity=4π×(area)/(circumference length)$^2$. In the circle equivalent diameter distribution, the circle equivalent diameter which becomes 50% of the accumulation from the small diameter side is caused to be the average primary particle diameter, the circularity which becomes 50% of the accumulation from the smaller side in the circularity distribution is caused to be the average circularity, and circularity which becomes 84% of the accumulation from the smaller side in the circularity distribution is caused to be the cumulative 84% circularity.

In the case of obtaining the shape properties of the strontium titanate particles from the toner to which other external additives other than the strontium titanate particle are externally added, after the other external additives are removed from the toner, the strontium titanate particles are separated from the toner, and the shape of the separated strontium titanate particles may be measured. Specifically, the following processing and measurement methods may be applied.

In a 200 mL glass bottle, 40 mL of a 0.2 mass % aqueous solution of TRITON X-100 (manufactured by Acros Organics B.V.B.A.) and 2 g of a toner are introduced and stirring is performed 500 times, so as to be dispersed. Subsequently, ultrasonic waves are applied by using an ultrasonic homogenizer (US-300AT, manufactured by Nippon Seiki Co., Ltd.) while the liquid temperature of the dispersion is maintained at 20° C.±0.5° C. Ultrasonic wave application is continuously performed for application time: 300 seconds, output: 75 W, amplitude: 180 μm, and a distance between the ultrasonic transducer and the bottom of the container: 10 mm. Subsequently, the dispersion is centrifuged at 3,000 rpm for 2 minutes at a cooling temperature of 0° C. by using a small high-speed cooling centrifuger (manufactured by Sakuma Seisakusho Co., Ltd, M201-IVD), the supernatant is removed, and the remaining slurry is filtrated through filter paper (manufactured by Advantech Co., Ltd., qualitative filter paper No. 5C, 110 nm). The residue on the filter paper is washed twice with ion exchanged water and dried, so as to obtain a toner from which a silica particle or a lubricant particle is removed.

Subsequently, in a 200 mL glass bottle, 40 mL of a 0.2 mass % aqueous solution of TRITON X-100 (manufactured by Acros Organics B.V.B.A.) and 2 g of the toner after the treatment are introduced and stirring is performed 500 times, so as to be dispersed. Subsequently, ultrasonic waves are applied by using an ultrasonic homogenizer (US-300AT, manufactured by Nippon Seiki Co., Ltd.) while the liquid temperature of the dispersion is maintained at 20° C.±0.5° C. Ultrasonic wave application is continuously performed for application time: 30 seconds, output: 75 W, amplitude: 180 μm, and a distance between the ultrasonic transducer and the bottom of the container: 10 mm. Subsequently, the dispersion is centrifuged at 3,000 rpm for 2 minutes at a cooling temperature of 0° C. by using a small high-speed cooling centrifuger (manufactured by Sakuma Seisakusho Co., Ltd, M201-IVD), so as to obtain a supernatant. After suction filtration is performed on the supernatant with a membrane filter (manufactured by Merck & Co., MF-Millipore membrane filter VSWP, pore size 0.025 μm), the residue on the membrane filter is dried so as to obtain strontium titanate particles.

The strontium titanate particles collected on the membrane filter are adhered onto a carbon support membrane (U1015, manufactured by EM Japan Co., Ltd.), air-blown, and then images are taken at a magnification of 320,000 times by using a transmission-type electron microscope (TEM) (Talos F200S, manufactured by FEI Co., Ltd.) equipped with an EDX apparatus (EMAX Evolution X-Max 80 mm$^2$, manufactured by Horiba Ltd.). 300 or more primary particles of strontium titanate are specified by EDX analysis from within one visual field based on the presence of Ti and Sr. Observation is performed with the TEM at an accelerating voltage of 200 kV and an emission current of 0.5 nA, and the EDX analysis is conducted under the same conditions for a detection time of 60 minutes.

Image information of specified strontium titanate particles is analyzed with an image processing analysis software WinRoof (Mitani Corporation) via an interface, and the circle equivalent diameter, the area, and the perimeter of each primary particle image are calculated, so as to obtain circularity=4π×(area)/(circumference length)$^2$. In the circle equivalent diameter distribution, the circle equivalent diameter which becomes 50% of the accumulation from the small diameter side is caused to be the average primary particle diameter, the circularity which becomes 50% of the accumulation from the smaller side in the circularity distribution is caused to be the average circularity, and circularity which becomes 84% of the accumulation from the smaller side in the circularity distribution is caused to be the cumulative 84% circularity.

X-Ray Diffraction of Strontium Titanate Particle

Each of the strontium titanate particles (1) to (7) before being externally added to the toner particles is subjected to the crystal structure analysis as a sample, by the X-ray diffraction method under the measurement conditions. The strontium titanate particles (1) to (7) have peaks corresponding to the peak of the (110) plane of the perovskite crystal near the diffraction angle of 2θ=32°. The half-widths of the peaks of the (110) plane are the following values, respectively.

Strontium Titanate Particle (1): Peak half-width 0.35°
Strontium Titanate Particle (2): Peak half-width 0.70°
Strontium Titanate Particle (3): Peak half-width 0.45°
Strontium Titanate Particle (4): Peak half-width 0.30°
Strontium Titanate Particle (5): Peak half-width 0.24°
Strontium Titanate Particle (6): Peak half-width 0.21°
Strontium Titanate Particle (7): Peak half-width 0.15°

Fixing Offset

Evaluation of Developer

The developer obtained in each example is filled in a developing device of ApeosPort IV C3370 manufactured by Fuji Xerox Co., Ltd., from which a fixing device is removed, the toner application amount is adjusted to be 0.45 mg/cm$^2$, such that an unfixed image of 50 mm×50 mm is formed. An unfixed image is fixed at a fixing temperature of 100° C. at an interval of 5° C. by using a fixing device having a nip width of 6 mm, a nip pressure of 1.6 kgf/cm$^2$, and a process speed of 175 mm/sec. The presence or absence of offset is checked by visually observing a fixing member, and the temperature at which the offset is disappeared is used as an index of fixing properties and is classified as follows.

A: An offset disappearance temperature is 140° C. or lower

B: An offset disappearance temperature is higher than 140° C. and 150° C. or lower C: An offset disappearance temperature is higher than 150° C. and 160° C. or lower D: An offset disappearance temperature is higher than 140° C.

TABLE 1

| | Toner particle | | | Titanium oxide particle | | Strontium titanate particle | | | | | | |
|---|---|---|---|---|---|---|---|---|---|---|---|---|
| | No. | Proportion of releasing agent exposed portion [atom %] | Average diameter A of releasing agent exposed portion [nm] | No. | Average primary particle diameter [nm] | No. | Dopant | Average primary particle diameter B [nm] | Average circularity | Cumulative 84% circularity | A/B | Fixing offset |
| Comparative Example 1 | (1) | 6 | 400 | (1) | 55 | | | — | | | 7.3 | D |
| Example 1 | (1) | 6 | 400 | | — | (1) | La | 50 | 0.880 | 0.935 | 8.0 | A |
| Example 2 | (1) | 6 | 400 | | — | (2) | La | 25 | 0.920 | 0.954 | 16.0 | B |
| Example 3 | (1) | 6 | 400 | | — | (3) | La | 40 | 0.900 | 0.941 | 10.0 | B |
| Example 4 | (1) | 6 | 400 | | — | (4) | La | 75 | 0.845 | 0.930 | 5.3 | C |
| Example 5 | (1) | 6 | 400 | | — | (5) | La | 90 | 0.825 | 0.923 | 4.4 | C |
| Comparative Example 2 | (1) | 6 | 400 | | — | (6) | La | 125 | 0.821 | 0.921 | 3.2 | D |
| Comparative Example 3 | (1) | 6 | 400 | | — | (7) | None | 80 | 0.888 | 0.916 | 5.0 | D |
| Comparative Example 4 | (2) | 1 | 300 | (1) | 55 | | | — | | | 5.5 | D |
| Example 6 | (2) | 1 | 300 | | — | (1) | La | 50 | 0.880 | 0.935 | 6.0 | A |
| Example 7 | (2) | 1 | 300 | | — | (2) | La | 25 | 0.920 | 0.954 | 12.0 | B |
| Example 8 | (2) | 1 | 300 | | — | (3) | La | 40 | 0.900 | 0.941 | 7.5 | B |
| Example 9 | (2) | 1 | 300 | | — | (4) | La | 75 | 0.845 | 0.930 | 4.0 | C |
| Example 10 | (2) | 1 | 300 | | — | (5) | La | 90 | 0.825 | 0.923 | 3.3 | C |
| Comparative Example 5 | (2) | 1 | 300 | | — | (6) | La | 125 | 0.821 | 0.921 | 2.4 | D |
| Comparative Example 6 | (2) | 1 | 300 | | — | (7) | None | 80 | 0.888 | 0.916 | 3.8 | D |
| Comparative Example 7 | (3) | 18 | 500 | (1) | 55 | | | — | | | 9.1 | D |
| Example 11 | (3) | 18 | 500 | | — | (1) | La | 50 | 0.880 | 0.935 | 10.0 | A |
| Example 12 | (3) | 18 | 500 | | — | (2) | La | 25 | 0.920 | 0.954 | 20.0 | B |
| Example 13 | (3) | 18 | 500 | | — | (3) | La | 40 | 0.900 | 0.941 | 12.5 | B |
| Example 14 | (3) | 18 | 500 | | — | (4) | La | 75 | 0.845 | 0.930 | 6.7 | C |
| Example 15 | (3) | 18 | 500 | | — | (5) | La | 90 | 0.825 | 0.923 | 5.6 | C |
| Comparative Example 8 | (3) | 18 | 500 | | — | (6) | La | 125 | 0.821 | 0.921 | 4.0 | D |
| Comparative Example 9 | (3) | 18 | 500 | | — | (7) | None | 80 | 0.888 | 0.916 | 6.3 | D |
| Comparative Example 10 | (4) | 0.7 | 120 | | — | (1) | La | 50 | 0.880 | 0.935 | 2.4 | D |
| Comparative Example 11 | (5) | 23 | 820 | | — | (1) | La | 50 | 0.880 | 0.935 | 16.4 | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle that contains a releasing agent, that has an exposed portion in which the releasing agent is exposed on a surface, and in which a proportion of the exposed portion occupying a surface, which is obtained by X-ray photoelectron spectroscopic analysis is 1 atom % or more to 20 atom % or less; and a strontium titanate particle that is externally added to the toner particle, that is doped with a metal element other than titanium and strontium, and in which an average primary particle diameter is 10 nm or more to 100 nm or less, wherein an average diameter of the exposed portions is 200 nm or more to 600 nm or less.

2. The electrostatic charge image developing toner according to claim 1, wherein the metal element is a metal element having an electronegativity of 2.0 or less.

3. The electrostatic charge image developing toner according to claim 2, wherein the metal element is lanthanum.

4. The electrostatic charge image developing toner according to claim 1, wherein, in the strontium titanate particle, an average primary particle circularity is 0.82 or more to 0.94 or less, and a primary particle circularity that becomes 84% of accumulation is greater than 0.92.

5. The electrostatic charge image developing toner according to claim 1, wherein in the strontium titanate particle, a half-width of a peak of a 110 plane obtained by an X-ray diffraction method is 0.2° or more to 2.0° or less.

6. The electrostatic charge image developing toner according to claim 1, wherein an average primary particle diameter of the strontium titanate particle is 20 nm or more to 80 nm or less.

7. The electrostatic charge image developing toner according to claim 6, wherein an average primary particle diameter of the strontium titanate particle is 30 nm or more to 60 nm or less.

8. The electrostatic charge image developing toner according to claim 1, wherein an amount of a dopant which is the metal element other than titanium and strontium is 0.1 mol % or more to 20 mol % or less with respect to strontium.

9. The electrostatic charge image developing toner according to claim 1, wherein an addition amount of the strontium titanate particle is 0.6 parts by mass or more to 2 parts by mass or less with respect to 100 parts by mass of the toner particle.

10. The electrostatic charge image developing toner according to claim 1, wherein an average diameter of the exposed portions is 240 nm or more to 300 nm or less.

11. The electrostatic charge image developing toner according to claim 1, wherein an average diameter A of the exposed portions and an average primary particle diameter B of the strontium titanate particle satisfy a relationship of $3 \leq A/B \leq 20$.

12. The electrostatic charge image developing toner according to claim 11, wherein an average diameter A of the exposed portions and an average primary particle diameter B of the strontium titanate particle satisfy a relationship of $5 \leq A/B \leq 10$.

13. The electrostatic charge image developing toner according to claim 1, wherein the strontium titanate particle is a strontium titanate particle having a hydrophobized surface.

14. The electrostatic charge image developing toner according to claim 13, wherein the strontium titanate particle is a strontium titanate particle having a surface hydrophobized with a silicon-containing organic compound.

15. An electrostatic charge image developer comprising:

the electrostatic charge image developing toner according to claim 1.

* * * * *